US007540264B2

(12) United States Patent
Degner et al.

(10) Patent No.: US 7,540,264 B2
(45) Date of Patent: Jun. 2, 2009

(54) INITIALIZATION OF ELECTROMECHANICAL VALVE ACTUATOR IN AN INTERNAL COMBUSTION ENGINE

(75) Inventors: Michael Degner, Novi, MI (US); John Grabowski, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/372,649

(22) Filed: Mar. 10, 2006

(65) Prior Publication Data

US 2006/0150933 A1 Jul. 13, 2006

Related U.S. Application Data

(63) Continuation of application No. 10/873,713, filed on Jun. 21, 2004, now Pat. No. 7,021,255.

(51) Int. Cl.
*F01L 9/04* (2006.01)

(52) U.S. Cl. ..... 123/90.11; 123/90.15

(58) Field of Classification Search ..... 123/90.11, 123/90.15, 90.16; 251/129.01, 129.1, 129.15, 251/129.16
See application file for complete search history.

(56) References Cited

U.S. PATENT DOCUMENTS 3,884,207 A 5/1975 Kuehn, III
4,794,890 A * 1/1989 Richeson, Jr. ..... 123/90.11
5,124,598 A 6/1992 Kawamura
5,596,956 A 1/1997 Ogawa et al.
5,669,341 A * 9/1997 Ushirono et al. ..... 123/90.11
5,775,276 A 7/1998 Yanai et al.
5,804,962 A 9/1998 Kather et al.
5,940,262 A 8/1999 Archer
6,186,100 B1 * 2/2001 Sawada ..... 123/90.11
6,201,681 B1 3/2001 Torii et al.
6,202,608 B1 3/2001 Yamaki et al.
6,363,895 B1 4/2002 Butzman et al.
6,374,783 B1 4/2002 Toriumi
6,463,896 B1 * 10/2002 Fujiwara et al. ..... 123/90.11
6,626,146 B1 9/2003 Yanai et al.
6,631,067 B2 10/2003 Newton et al.
7,021,255 B2 4/2006 Degner et al.
7,036,469 B2 5/2006 Degner et al.

(Continued)

FOREIGN PATENT DOCUMENTS

DE 19701471 7/1998

(Continued)

OTHER PUBLICATIONS

Abstract of JP2007073834A shown above.*

*Primary Examiner*—Zelalem Eshete
(74) *Attorney, Agent, or Firm*—Allan J. Lippa; Alleman Hall McCoy Russell & Tuttle LLP

(57) ABSTRACT

A method for initializing valves of an engine having a starting apparatus is disclosed. The engine may have electromechanically actuated cylinder valves. The method comprises moving at least a first valve away from a neutral position of the first valve before the engine is rotated by said starting apparatus; and moving at least a second valve away from a neutral position of the second valve after the engine is rotated by said starting apparatus.

11 Claims, 17 Drawing Sheets

U.S. PATENT DOCUMENTS

| | | | | |
|---|---|---|---|---|
| 7,051,687 | B2 * | 5/2006 | Shimizu et al. | 123/90.11 |
| 7,054,737 | B2 | 5/2006 | Degner et al. | |
| 2002/0104494 | A1 | 8/2002 | Ozawa et al. | |
| 2005/0207086 | A1 | 9/2005 | Degner et al. | |

FOREIGN PATENT DOCUMENTS

| | | | |
|---|---|---|---|
| EP | 1010867 | | 7/2004 |
| JP | 2000/073834 | | 3/2000 |
| JP | 2000073834 A | * | 3/2000 |

* cited by examiner

INITIALIZATION OF ELECTROMECHANICAL VALVE ACTUATOR IN AN INTERNAL COMBUSTION ENGINE

CROSS-REFERENCE TO RELATED APPLICATIONS

The present application is a continuation of U.S. patent application Ser. No. 10/873,713, filed Jun. 21, 2004 now U.S. Pat. No. 7,021,255, and entitled "Initialization of Electromechanical Valve Actuator in an Internal Combustion Engine," the entire contents of which are incorporated herein by reference.

FIELD

The field of the disclosure relates to initialization of electric valves coupled to cylinder valves of an internal combustion engine, and more particularly for a dual coil valve actuator.

BACKGROUND

Electric valve actuators can be used to actuate cylinder valves, such as intake and/or exhaust valves of an internal combustion engine. When using electric valve actuators for such systems, it may be beneficial to initialize the valves to preselected positions to reduce battery loading.

One approach for initializing valves is described in U.S. Pat. No. 6,202,608. As illustrated in FIG. 5, all of the electrically actuated cylinder valves are initialized before cranking of the engine begins. This operation allegedly reduces the maximum consumption current by the initial attraction for the valves and suppresses a reduction in the output voltage of the battery.

However, the inventors herein have recognized a disadvantage with such an approach. In particular, because all of the valves are initialized before cranking begins, total engine starting time can be lengthened. Thus, the delay between a requested start by the driver and the actual engine start can be increased, thereby leading to degraded customer satisfaction. Further, in the case illustrated in FIG. 5 where the valves are all maintained closed, battery loading may actually be increased during cranking due to the increasing pumping work required to compress the air trapped in the cylinders.

SUMMARY

The above disadvantages can be overcome by a method for initializing valves of an engine having a starting apparatus, the method comprising:

moving at least a first valve away from a neutral position of the first valve before the engine is rotated by the starting apparatus; and moving at least a second valve away from a neutral position of the second valve during engine rotation by the starting apparatus.

In this way, engine starting time may be decreased since, in one example, less than all of the engine cylinder valves may be initialized before engine rotation begins, at least under some conditions. Further, by leaving at least one valve in a neutral, or mid position, (which can be a partially opened position in some examples) until after rotation has begun, energy needed to rotate the engine can be decreased since the piston does not need to be moved against as much vacuum or compressed air as that created by closed valves.

Note that there are various ways to move a valve away from a neutral position, which may include pulling the valve to an open or closed position, or oscillating the valve away from a neutral position. The neutral position may be a partially open position, a closed position, or an open position, for example. Note also that there are various approaches for rotating an engine, such as via a starter motor or integrated starter/alternator assembly. Further note that moving valves during rotation of the engine may include moving after rotation of the engine has begin, or simultaneously moving a valve at the beginning of engine rotation, for example.

In another aspect of the present disclosure, a system for an engine comprises at least one electromechanically actuated valve coupled to the engine; at least mechanically driven valve coupled to the engine; and a controller for moving at least said electromechanically actuated valve away from a neutral position of said electromechanically actuated valve during engine rotation. In this way, it may be possible to reduce power consumption during starting since at least one valve is mechanically driven.

BRIEF DESCRIPTION OF THE DRAWINGS

FIG. 6A shows a bi-directional dual coil converter (split supply version) and FIG. 6B shows a bi-directional dual coil converter (boosted supply version);

DESCRIPTION OF EXAMPLE EMBODIMENTS

Various example methods for initializing the valves in an Electro-Magnetic Valve Actuation (EVA) system are described. Among other things, the example methods relate to one or more of the following factors that may be relevant during the start-up phase of an EVA system:

1) initializing the valves into their desired position for an engine start, which may be completed in a selected period of time, 2) consideration of the power supply capability, which may limit the number of valves that can be initialized simultaneously or non-simultaneously (e.g., battery state of charge, battery voltage, battery temperature, or combinations thereof, or others), 3) coordination of the valve initialization with the engine start-up process, e.g., starting rotation of the engine after certain valves are initialized, reducing the starter loading by starting engine rotation with valves in the open position, etc., and 4) EVA actuator driver circuitry specific requirements that may constrain the number and order in which the valves can be initialized. As an example of the fourth factor, when a split supply dual coil half bridge converter (described below herein) is used, the power supply midpoint voltage may be regulated within a specified range in order to provide desired operation of the actuators. Other forms of actuator driver circuitry may place similar constraints on the method used to initialize the valve positions.

The following description illustrates various example systems and approaches for engine control and/or valve initialization in an EVA engine.

Figure 1:
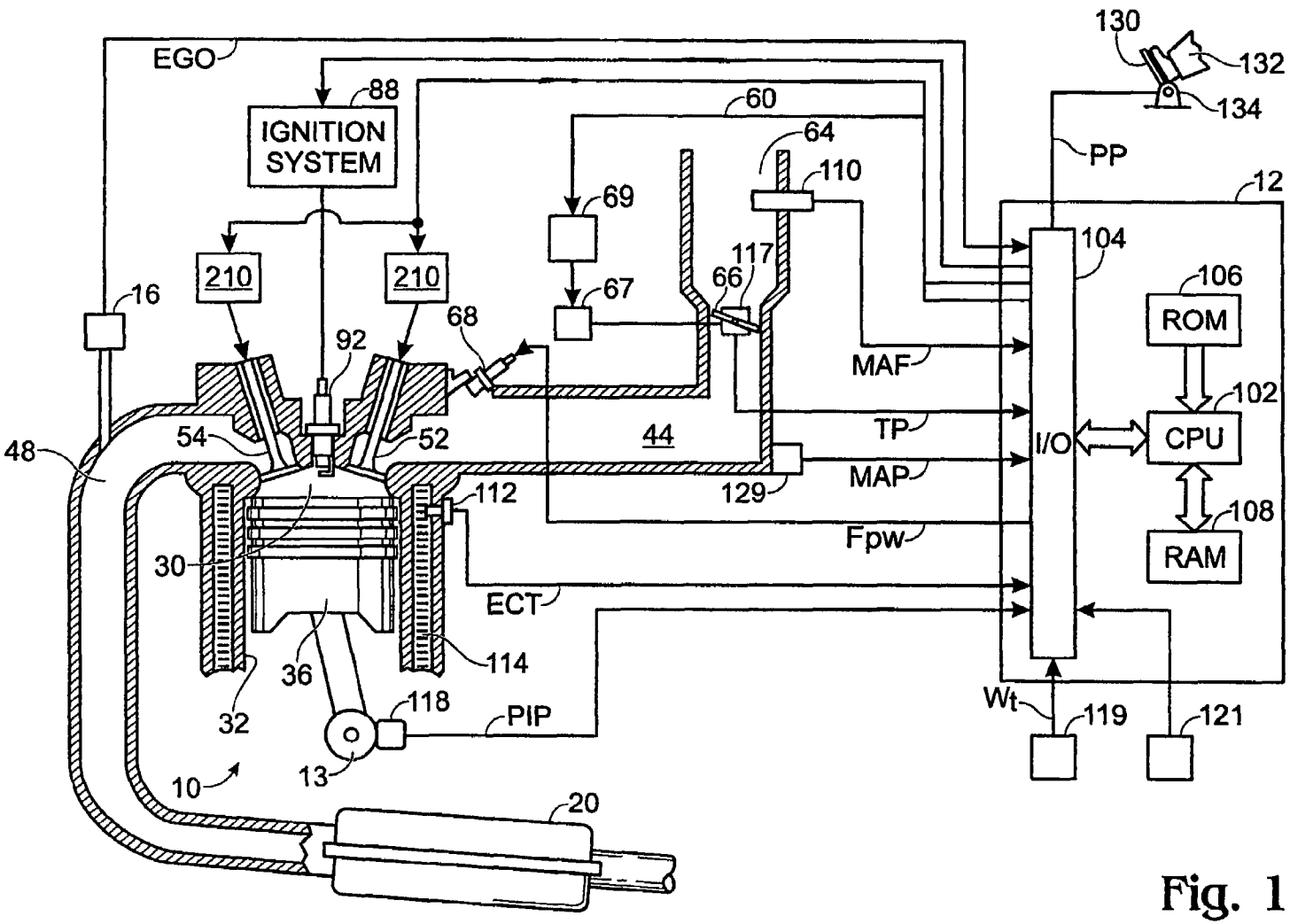
FIG. 1 is a block diagram of an engine illustrating various components.

Referring now specifically to FIG. 1, internal combustion engine 10 is shown with an EVA system. Engine 10 may be an engine of a passenger vehicle or truck driven on roads by drivers. Engine 10 can coupled to torque converter via crankshaft 13. The torque converter can also be coupled to transmission via a turbine shaft. The torque converter may have a bypass clutch, which can be engaged, disengaged, or partially engaged. When the clutch is either disengaged or partially engaged, the torque converter may be said to be in an unlocked state. The turbine shaft may also be known as transmission input shaft. The transmission may comprise an electronically controlled transmission with a plurality of selectable discrete gear ratios. The transmission may also comprise various other gears such as, for example, a final drive ratio. The transmission can also be coupled to tires via an axle. The tires interface the vehicle to the road.

Internal combustion engine 10 comprises a plurality of cylinders, one cylinder of which is shown in FIG. 1. Engine 10 may be controlled by electronic engine controller 12. Engine 10 may include combustion chamber 30 and cylinder walls 32 with piston 36 positioned therein and connected to crankshaft 13. Combustion chamber 30 may communicate with intake manifold 44 and exhaust manifold 48 via respective intake valve 52 and exhaust valve 54. Exhaust gas oxygen sensor 16 may be coupled to exhaust manifold 48 of engine 10 upstream of catalytic converter 20. In one example, converter 20 is a three-way catalyst for converting emissions during operation about stoichiometry. Additional exhaust gas oxygen sensors can be use in various other locations of the exhaust, if desired.

As described more fully below with regard to FIGS. 2A and 2B, at least one of, and potentially both, of valves 52 and 54 are controlled electronically via apparatus 210 (which may be part of controller 12, or a separate controller).

Intake manifold 44 communicates with throttle body 64 via throttle plate 66. Throttle plate 66 may be controlled by electric motor 67, which receives a signal from ETC driver 69. ETC driver 69 may receive control signal from controller 12. In an alternative embodiment, no throttle is utilized and airflow may be controlled using valves 52 and 54. Further, when throttle 66 is included, it can be used to reduce airflow if valves 52 or 54 become degraded, or to create vacuum to draw in recycled exhaust gas (EGR), or fuel vapors from a fuel vapor storage system having a valve controlling the amount of fuel vapors.

Intake manifold 44 may also have fuel injector 68 coupled thereto for delivering fuel in proportion to the pulse width of signal (fpw) from controller 12. Fuel may be delivered to fuel injector 68 by a conventional fuel system (not shown) including a fuel tank, fuel pump, and fuel rail (not shown). Engine 10 may further include conventional distributorless ignition system 88 to provide ignition spark to combustion chamber 30 via spark plug 92 in response to controller 12. In the embodiment described herein, controller 12 may be a conventional microcomputer including: microprocessor unit 102, input/output ports 104, electronic memory chip 106, which is an electronically programmable memory in this particular example, random access memory 108, and a data bus.

Controller 12 may receive various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of manifold pressure from MAP sensor 129, a measurement of throttle position (TP) from throttle position sensor 117 coupled to throttle plate 66; a measurement of transmission shaft torque, or engine shaft torque from torque sensor 121, a measurement of turbine speed (Wt) from turbine speed sensor 119, and a profile ignition pickup signal (PIP) from Hall effect sensor 118 coupled to crankshaft 13 indicating an engine speed (N). Alternatively, turbine speed may be determined from vehicle speed and gear ratio.

Continuing with FIG. 1, accelerator pedal 130 is shown communicating with the driver's foot 132. Accelerator pedal position (PP) can be measured by pedal position sensor 134 and sent to controller 12.

In an alternative embodiment, where an electronically controlled throttle is not used, an air bypass valve (not shown) can be installed to allow a controlled amount of air to bypass throttle plate 62. In this alternative embodiment, the air bypass valve (not shown) receives a control signal (not shown) from controller 12.

Also, in yet another alternative embodiment, intake valve 52 can be controlled via actuator 210, and exhaust valve 54 actuated by an overhead cam, or a pushrod activated cam. Further, the exhaust cam can have a hydraulic actuator to vary cam timing, known as variable cam timing. Such a configuration may still provide many benefits of electromechanically driven intake valves and variable exhaust valve timing, but may reduce energy draw during starting of the engine since a reduced number of valves need to be initialized away from a mid position.

In still another alternative embodiment, only some of the intake valves can be electrically actuated, and other intake valves (and exhaust valves) can be cam actuated.

Note that the engine EVA system is not limited to a dual coil actuator, but rather it can be used with other types of actuators. For example, the actuators of FIGS. 2 or 3 can be single coil actuators. Note also that in some example, engine output (e.g., torque, air charge, airflow) can be adjusted by varying intake valve opening/closing timing (or combinations thereof), or intake valve lift, or combinations thereof, rather than, or in addition to, adjusting position of the throttle plate.

Figure 2B:
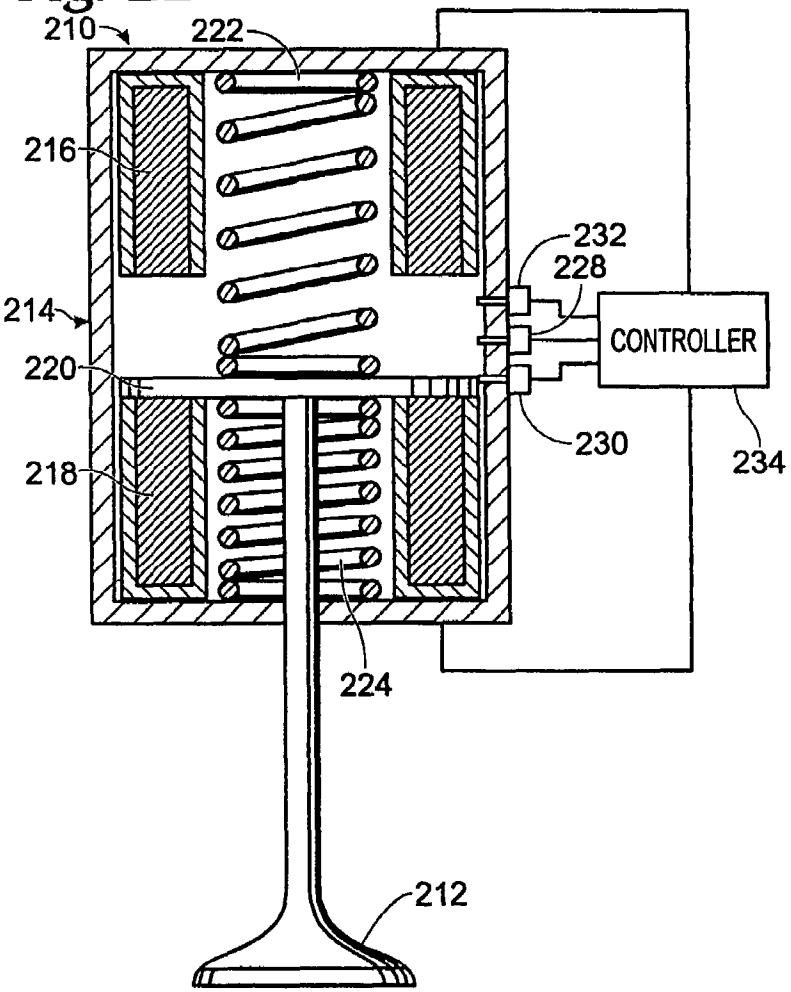
FIG. 2B shows a schematic vertical cross-sectional view of an apparatus for controlling valve actuation as shown in FIG. 3, with the valve in the fully open position.
Figure 2A:
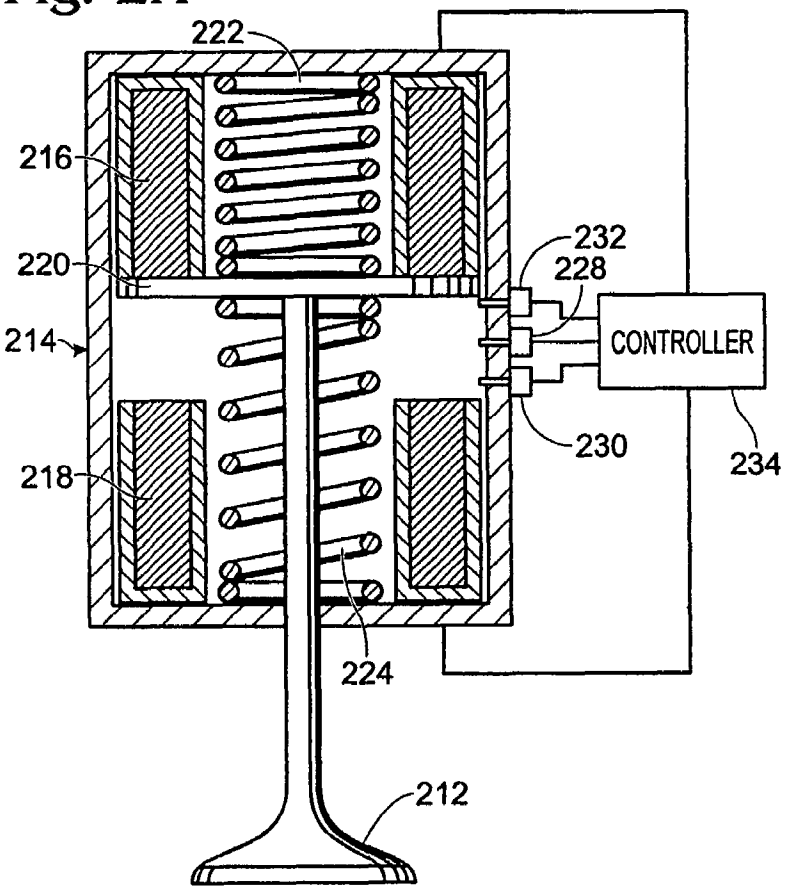
FIG. 2A show a schematic vertical cross-sectional view of an apparatus for controlling valve actuation, with the valve in the fully closed position.

Referring to FIGS. 2A and 2B, an apparatus 210 is shown for controlling movement of a valve 212 in engine 10 between a fully closed position (shown in FIG. 2A), and a fully open position (shown in FIG. 2B). The apparatus 210 includes an electromagnetic valve actuator (EVA) 214 with upper and lower coils 216 and 218 which electromagnetically drive an armature 220 against the force of upper and lower springs 222 and 224 for controlling movement of the valve 212.

Switch-type position sensors 228, 230, and 232 are provided and installed so that they switch when the armature 220 crosses the sensor location. It is anticipated that switch-type position sensors can be easily manufactured based on optical technology (e.g., LEDs and photo elements) and when combined with appropriate asynchronous circuitry they would yield a signal with the rising edge when the armature crosses the sensor location. It is furthermore anticipated that these sensors would result in cost reduction as compared to continuous position sensors, and would be more reliable.

Controller 234 (which can be combined into controller 12, or act as a separate controller) is operatively connected to the position sensors 228, 230, and 232, and to the upper and lower coils 216 and 218 in order to control actuation and landing of the valve 212.

The first position sensor 228 is located around the middle position between the coils 216 and 218, the second sensor 230 is located close to the lower coil 218, and the third sensor 232 is located close to the upper coil 216.

As described above, engine 10, in one example, has an electro-mechanical valve actuation (EVA) with the potential to improve torque over a broad range of engine speeds and substantially improve fuel efficiency. The increased fuel efficiency benefits are achieved by eliminating the throttle, and its associated pumping losses, (or operating with the throttle substantially open, in at least some operating conditions) and by controlling the engine operating mode and/or displacement, through the direct control of the valve timing, duration, and/or lift, on an event-by-event basis, or combinations thereof.

In one example, controller 234 includes any of the example power converters described below.

While the above method can be used to control valve position, an alternative approach can be used that includes continuous position sensor feedback for potentially more accurate control of valve position. This can be use to improve overall position control, as well as valve landing, to possibly reduce noise and vibration.

Figure 3:
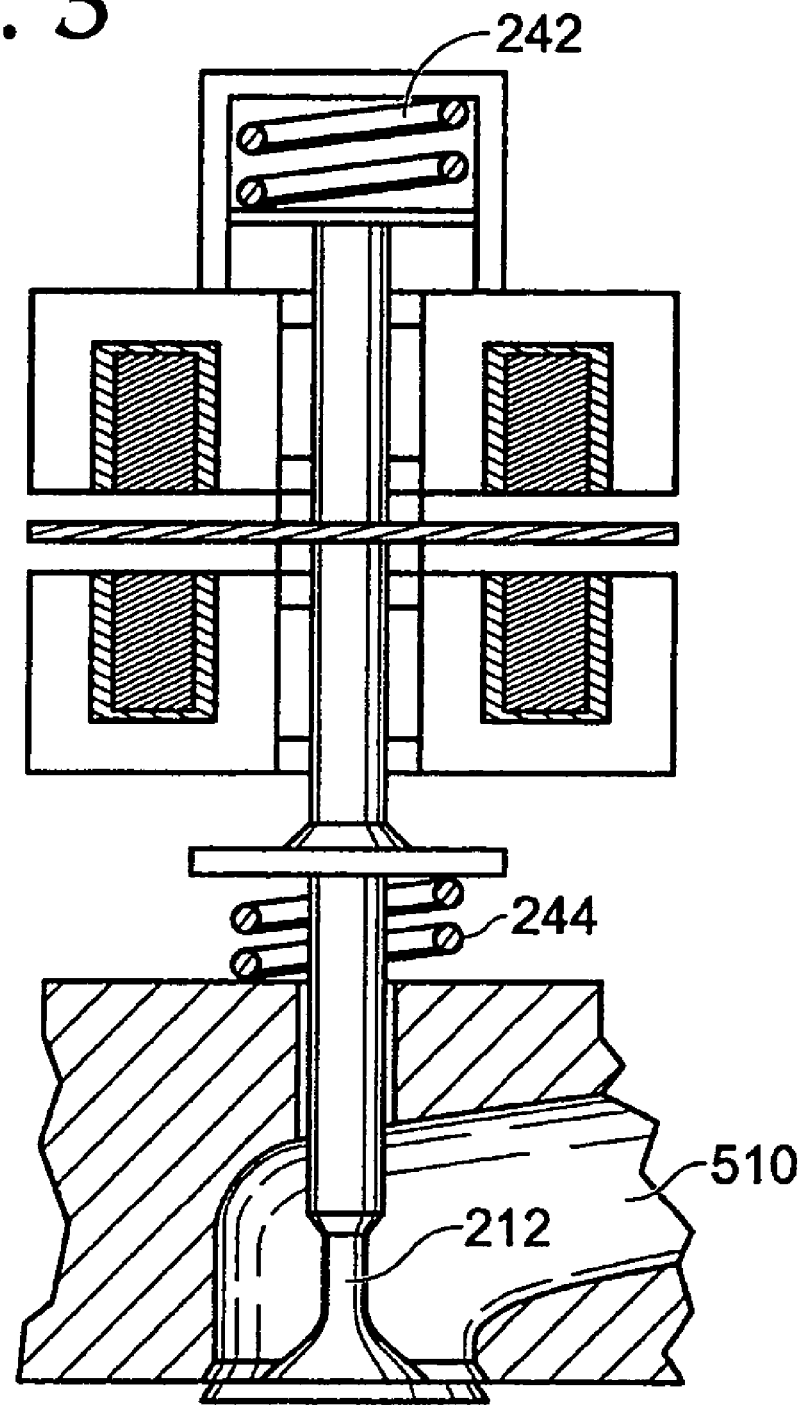
FIG. 3 shows an alternative electronic valve actuator configuration.

FIG. 3 shows an alternative embodiment dual coil oscillating mass actuator with an engine valve actuated by a pair of opposing electromagnets (solenoids), which are designed to overcome the force of a pair of opposing valve springs 242 and 244 located differently than the actuator of FIGS. 2A and 2B (other components are similar to those in FIGS. 2A and 2B, except that FIG. 3 shows port 510, which can be an intake or exhaust port). Applying a variable voltage to the electromagnet's coil induces current to flow, which controls the force produced by each electromagnet. Due to the design illustrated, each electromagnet that makes up an actuator can only produce force in one direction, independent of the polarity of the current in its coil. High performance control and efficient generation of the required variable voltage can therefore be achieved by using a switch-mode power electronic converter, for example. Other power electronics could also be used.

As illustrated above, the electromechanically actuated valves in the engine may remain in the half open position when the actuators are de-energized. Therefore, prior to engine combustion operation, each valve may go through an initialization cycle. During an initialization period, the actuators can be pulsed with current, in a prescribed manner, in order to establish the valves in the fully closed or fully open position. Following this initialization, the valves can be sequentially actuated according to the desired valve timing (and firing order) by the pair of electromagnets, one for pulling the valve open (lower) and the other for pulling the valve closed (upper).

The magnetic properties of each electromagnet are such that only a single electromagnet (upper or lower) need be energized at any time. Since the upper electromagnets may hold the valves closed for the majority of each engine cycle, they may be operated for a much higher percentage of time than that of the lower electromagnets.

In one example, during power-up in an EVA engine, all (or a portion) of the electromechanically valves can be held in the half open position by a pair of valve springs, as shown by FIG. 3. When compressed, these springs can have sufficient force to act on the valve in such a way as to force it to traverse the air gap into the open or closed position. Once the valve has been transitioned into either the open or closed position, the electro-magnetical (EM) solenoids may be energized, and they catch the armature and hold the valve in that position. Once the valve is caught and held, the power required to maintain that position may be greatly reduced.

Initially the EM solenoids can bring the valve from a center (rest) position to either the fully open or fully closed positions. This may be accomplished for each valve, i.e., up to thirty-two valves in a 4 electromechanically actuated valve per cylinder 8-cylinder engine, to move the valves into positions that allow a start-up of the engine.

In order to initialize electromechanically actuated valves, various high level control routines can be used. Further, the control routines included herein can be used with various engine configurations, such as those described above and/or below. As will be appreciated by one of ordinary skill in the art, the specific routine described below in the flowchart(s) may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing may not necessarily be required to achieve the features and advantages of the example embodiments of the invention described herein, but may be provided for ease of illustration and description. Although not explicitly illustrated, one of ordinary skill in the art will also recognize that one or more of the illustrated steps or functions may be repeatedly performed depending on the particular strategy being used. Further, the flowchart(s) below graphically represents code to be programmed into the computer readable storage medium in controller 12, or 230, or combinations thereof.

In one example, a method to robustly initialize an EVA engine valvetrain is described. In one approach, the electromechanically actuated valves may be brought from the center, de-energized position to an initialized open or closed position without unnecessarily lengthening the time to start the engine, or without unnecessarily depleting battery storage. To do this, under some conditions, it may be desirable to initialize multiple valves simultaneously in order to minimize the overall time required. However, in other conditions, it may be desirable to initialize multiple valves sequentially. Thus, the number and order in which the valves are initialized may be constrained by the capability of the vehicle power supply, the engine startup process, and the capability of the actuator driver circuitry. Because these constraints vary throughout the usage and life of the vehicle/engine, it may also be desirable to have a process that robustly takes these factors into consideration to robustly initialize the valves in the EVA system.

As noted above, the initialization of a single valve can be done by either directly pulling-in the valve or creating an oscillation that assists in pulling-in the valve, for example. The direct pull-in method works by energizing one of the two coils in the actuator, either the open or close coil, and using the force produced by that coil to directly pull the valve to either the open or closed position in a single stroke. Because of the large force needed to overcome the actuator/valve spring forces, the direct pull-in method may require a relatively large instantaneous power, which may reduce the number of valves that can be simultaneously initialized. The oscillating pull-in method works by alternatively energizing the two coils in the actuator to excite the spring-mass oscillator's natural resonance, which may reduce the amount of power required to initialize the valve position but may increases the time required. Either approach, or still other approaches, can be used in the approaches described herein.

Figure 4:
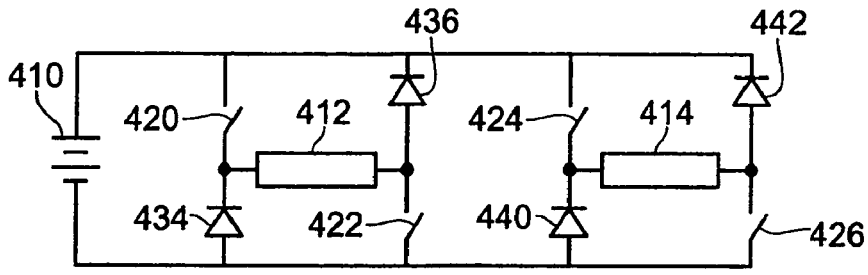
FIG. 4 shows an example embodiment including a half-bridge converter.
Figure 5:
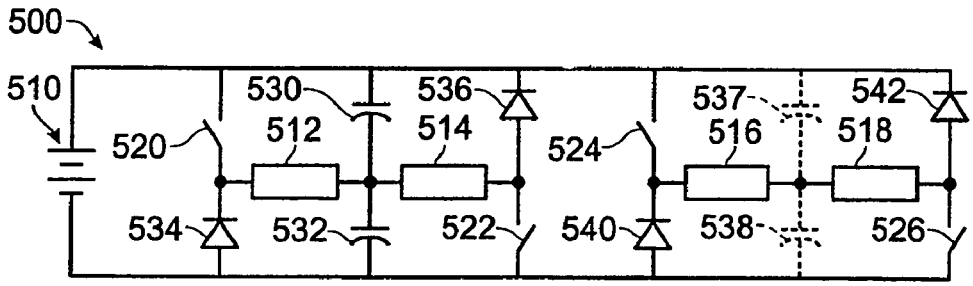
FIG. 5 shows an example embodiment including a split supply dual coil half-bridge converter.
Figure 6:
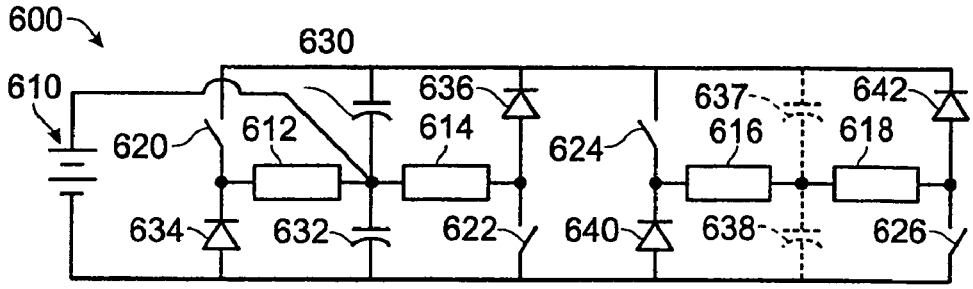
FIG. 6 shows an example embodiment including a boosted supply dual coil half-bridge converter.

Examples of EVA driver circuits are shown in FIGS. 4-6. Various example power converter topologies are shown that may be used, if desired. One power converter topology that could be used to generate the voltage for this application is a half bridge converter. However, a drawback of the half bridge drive is that four power devices (2 switches and 2 diodes) are required for each electromagnet. With a typical 32 valve V-8 engine requiring 256 devices, an alternative topology that could offer a reduction in device count may provide a large improvement in cost, complexity and package space requirement.

While FIGS. 2A, 2B, and 3 appear to show the valves to be permanently attached to the actuators, in practice there can be a gap to accommodate lash and valve thermal expansion.

Referring now to FIG. 4, a diagram shows one embodiment of a half-bridge converter, with power supply (such as, for example, the vehicle battery) 410 and two actuator coils (412 and 414). In one embodiment, actuator coils 412 and 414 may represent the two coils of an intake valve actuator in a cylinder of the engine. In another embodiment, actuator coils 412 and 414 may represent the two coils of different intake valve actuators in the engine. Further, in another embodiment, actuator coils 412 and 414 may represent the two coils of an exhaust valve actuator in a cylinder of the engine.

Continuing with FIG. 4, four switches are shown (420, 422, 424, and 426), with each switch pair providing current to an actuator. Four diodes are shown (434, 436, 440, and 442). The diodes may provide for flyback current (or freewheel current) when deactivating a switch due to the high inductance of the actuator coils. However, other converter topologies can be used, such as in FIGS. 5 and 6 discussed below.

Referring now to FIG. 5, a diagram shows one embodiment of a split supply dual coil half-bridge converter, which may require half the number of power devices and gate drive circuits when compared with a half-bridge converter, while providing the ability for accurate valve control. This configuration can therefore result in a significant cost savings for the valve control unit (VCU) of the EVA system. In addition, this example converter may also cut the number of power wires between the valve control unit and the actuators in half, compared with a half-bridge converter, which may significantly reduce the wire harness/connectors cost and weight.

Note that while the examples herein use a dual coil actuator, the converter topology is not limited to dual coil actuators. Rather, it can be used with any system that utilizes multiple actuator coils. Thus, it should be noted that adjacent pairs of converter switches are not necessarily confined to be paired with a single actuators' coils (i.e. each coil of a given actuator may be driven by switches from different legs of the converter).

In the above example, a split-power supply, which provides a return path for the actuator coil currents, is used. In one example, the split supply could be realized using a pair of batteries. However, this may unnecessarily add cost and weight to the vehicle. Therefore, in another example, a split capacitor bank 530 and 532 can be used to transform a single battery into a dual voltage source, as shown in FIG. 5.

Note that a capacitor is an example of an energy storage device, and various types of devices can be used to act as a capacitor or energy storage device. Note also that a diode is an example of a unidirectional current device that allows current only to flow in substantially one direction. Various other devices could also be used to provide a diode type function.

In the example dual coil half-bridge design, each actuator coil is connected to the split voltage supply through what can be thought of as a DC/DC converter. Those connected using a high-side switch form a buck DC/DC converter from the supply voltage to the split voltage (mid-point voltage), and those connected using a low-side switch form a boost DC/DC converter from the split voltage to the supply voltage.

The coils are actuated via their respective switches, and the capacitors alternate charge and discharge during the operation of the coils.

Referring now specifically to FIG. 5, an example converter circuit 500 is shown, with power supply (such as, for example, the vehicle battery) 510 and four actuator coils (512, 514, 516, and 518). However, any type of power source could be used. Also, in an alternative embodiment, the single voltage source could be replaced with a dual voltage source (i.e. two voltage sources, each placed in parallel across each of the two split capacitors).

In one embodiment, actuator coils 512 and 514 represent the two coils of an intake valve actuator in a cylinder of the engine, and actuator coils 516 and 518 represent an exhaust valve actuator of the same cylinder of the engine. In another embodiment, actuator coils 512 and 514 represent the two coils of an intake valve actuator in a cylinder of the engine, and actuator coils 516 and 518 represent an intake valve actuator in another (different) cylinder of the engine. Further, in another embodiment, actuator coils 512 and 514 represent the two coils of an exhaust valve actuator in a cylinder of the engine, and actuator coils 516 and 518 represent an exhaust valve actuator in another (different) cylinder of the engine. As indicated and discussed below, certain configuration can provide a synergistic result in terms of maintaining a balance of charge in the capacitors.

Continuing with FIG. 5, four switches are shown (520, 522, 524, and 526), with each switch providing current to an actuator coil (e.g., 520 energizes/de-energizes 512; 522 energizes/de-energizes 514; 524 energizes/de-energizes 516; 526 energizes/de-energizes 518). Two capacitors are shown (530 and 532 are shown, along with two diodes (534 and 536) for actuator coils 512 and 514). The diodes provide for flyback current (or freewheel current) when deactivating a switch due to the high inductance of the actuator coils. Further, two diodes 540 and 542 are shown for actuator coils 516 and 518. Optionally, two additional capacitors 537 and 538 can be used, where the values of 530 and 537 are the same, as well as the values of 532 and 538, for example. In one example, capacitors 530 and 532 have substantially equal capacitance, however different capacitances can also be used, if desired. This is an example of a split capacitor voltage source (SCVS). In one example, capacitors 530 and 537 are the same physical capacitor and capacitors 532 and 538 are the same physical capacitor.

An alternative arrangement would have the four actuator coils be the upper and lower coils for two intake or two exhaust actuators on the same cylinder. In this case, coils 512 and 514 would be the two upper coils of the two actuators and 516 and 518 would be the two lower coils (or vice versa).

Example operation of the converter of FIG. 5 is now described for different switch actuation situations. This description relates to actuation of coils 512 and 514 only, however can be easily extended to each coil in the converter.

Initially, assuming all switches are open, and assuming a 12 volt power source 510, each capacitor 530 and 532 has 6 volts across it, and diode 536 is blocking current flow. When an increase in current flowing in coil 512 is desired, switch 520 is closed. At this time, a positive voltage is applied across coil 512 from the 12 volt potential (top circuit line) through switch 520 causing the current level in coil 512 to increase. After some time, the charge on capacitor 530 has decreased and the charge on capacitor 532 has increased, resulting in an increased voltage across capacitor 532 (since the pair of capacitors are sized such that they have enough capacity to withstand normal excursions in actuator current with only small changes in their terminal voltage). Then, when a decrease in the current level in coil 512 is desired, switch 520 is opened. The current flowing through coil 512 forces diode 534 to conduct (turn-on), which applies a negative voltage across coil 512, causing the current level in coil 512 to decrease. After some time, the charge on capacitor 530 has increased and the charge on capacitor 532 has decreased, resulting in a reduced voltage across capacitor 532. When another increase in current is desired, the process is repeated.

Operation of the coil 514 proceeds concurrently with the operation described above for coil 512 and is as follows. When a decrease in the current flowing in coil 514 is desired, switch 522 is closed (positive current flow defined as flowing from the point connecting coil 514 to switch 522 into the point connecting coil 514 to capacitors 530 and 532). At this time, a negative voltage is applied across coil 514 through switch 522 causing the current level in coil 514 to decrease. After some time, the charge on capacitor 530 has increased and the charge on capacitor 532 has decreased, resulting in a reduced voltage across capacitor 532 (since the pair of capacitors are sized such that they have enough capacity to withstand normal excursions in actuator current with only small changes in their terminal voltage). Then, when an increase in the current level in coil 514 is desired, switch 522 is opened. The current flowing through coil 514 forces diode 536 to conduct (turn-on), which applies a positive voltage across coil 514, causing the current level in coil 514 to increase. After some time, the charge on capacitor 530 has decreased and the charge on capacitor 532 has increased, resulting in a increased voltage across capacitor 532. When another decrease in current is desired, the process is repeated.

The operation of the circuit for coils 516 and 518 and for any additional coils in the system may follow a similar procedure to that described above for coils 512 and 514. It should also be noted that the above described operations, alternatively increase and decrease the 6 volt balance across the capacitors 530 and 532, on average this alternating action will act to balance the voltages on the two capacitors.

The above is an example description of how the converter may be operated. The example converter of FIG. 5 can provide a current versus voltage operating range allowing substantially the same functionality as a half bridge converter, and it may also reduce cost and complexity.

Note that while only four actuator coils are shown in FIG. 5, additional stages can be created and cascaded so that all of the valve actuators are included, each with a single actuating switch.

In FIG. 5, a single phase consists of a switch (520), a diode (534), an actuator coil (512), and the SCVS (capacitors 530 and 532). The operation of each phase, whether high-side or low-side switched, is similar. Specifically, a desired voltage for a given coil is commanded and the power switch for that coil is modulated to produce the desired voltage. The adjacent diode is required to conduct the current in the coil during periods when the switch is turned off. Each coil can be independently voltage controlled without any constraints from the other coils. The SCVS consisting of capacitors 530 and 532 are common to all coil pairs, that is, only the two capacitors are required for the entire converter.

However, the split-capacitor voltage source arrangement may result in different charges being stored in the capacitors, due to the unequal current applied to different coils (e.g., opening versus closing, intake versus exhaust, or combinations thereof, for example). In other words, the balance of charge can be affected by the configuration of these coils in the dual coil half-bridge converter, and therefore the configuration can cause various types of results. Thus, in one example, system configuration is selected to maintain the balance of the charge on each capacitor. However, this system has to contend with the high number of coils in the engine, and the wide range of current that each is conducting.

One method of connecting the coils that assists in advantageously maintaining the required balance is to connect an equal number of similar loads (i.e. upper/lower (high-side/low side) coils, exhaust/intake valves) in either the buck DC/DC converter configuration or the boost DC/DC converter configuration. When the total load through the buck converter connected coils matches that through the boost converter connected coils, a natural balance of the split voltage supply can occur.

However, the inventors herein have recognized that various alternative modes of operation may also affect the balance of charge, such as during starting of the engine. Thus, by proper selection of which valves to actuate and which to hold closed/open on each cylinder, it may be possible to obtain improved charge balance in the converter. Further, proper selection for each cycle may also aid in maintaining the balance of the split voltage supply. Also, by appropriately selecting the connection of the coils in the converter, improved charge balance may be achieved. Thus, in addition to selecting which valve to operate, coil connection in the converter may be used to improve balancing. I.e., obtaining charge balance through selection of which valve to operate limits the operating modes available, whereas connecting the coils in a preferred fashion increases the operating modes available.

The concept described above for configuring the actuator coils to the split voltage supply can also be applied to other engine configures (I4, V6, etc.) and to differing number of intake and exhaust valves.

Still another alternative embodiment can be accomplished by changing the wiring connections between the battery and the capacitors, as shown in FIG. 6. This alternate circuit configuration has substantially the same circuit function as the circuit in FIG. 5. However, one difference in the boosted circuit design of FIG. 6 is the battery is now connected across only one half of the split voltage supply (between capacitors). The configuration of the coils to aid in maintaining a charge balance using this configuration of the converter may follow the same procedure as described for the design shown in FIG. 5. Again, each configuration for the dual coil half-bridge converter provides substantially similar function, however, the voltage and current rating of the converter components would be different due to the difference in currents and voltages.

Referring now specifically to FIG. 6, an example converter circuit 600 is shown, with power supply (such as, for example, the vehicle battery) 610 and four actuator coils (612, 614, 616, and 618). As above, various types of power supplies may be used. As also noted above with regard to FIG. 5, coils 612, 614, 616, and 618 can be connected in various ways to intake and/or exhaust valves.

Continuing with FIG. 6, four switches are shown (620, 622, 624, and 626), with each switch providing current to an actuator (e.g., 620 energizes/de-energizes 612; 622 energizes/de-energizes 614; 624 energizes/de-energizes 616; 626 energizes/de-energizes 618). Two capacitors are shown (630 and 632 are shown, along with two diodes (634 and 636) for actuators 612 and 614). The diodes provide for flyback current (or freewheel current) when deactivating a switch due to the high inductance of the actuator coils. Further, two diodes 640 and 642 are shown for actuator coils 616 and 618. Optionally, two additional capacitors 637 and 638 can be used, where the values of 630 and 637 are the same, as well as the values of 632 and 638, for example. In one example, capacitors 630 and 632 have substantially equal capacitance, however different capacitances can also be used, if desired. This is an example of a split capacitor voltage source (SCVS). In one example, capacitors 630 and 637 are the same physical capacitor and capacitors 632 and 638 are the same physical capacitor.

An alternative arrangement would have the four actuator coils be the upper and lower coils for two intake or two exhaust actuators on the same cylinder. In this case, coils 612 and 614 would be the two upper coils of the two actuators and 616 and 618 would be the two lower coils (or vice versa).

As discussed above, FIG. 6 shows a version (split supply) of the dual coil half-bridge converter that can be used for controlling valve actuators in an EVA system. The split capacitor bank is used to transform a single battery into a dual voltage source, where the system voltage level would be chosen based on the actuator performance considerations. Further, as noted above, each actuator coil is connected to the split voltage supply through what can be thought of as a DC/DC converter—those connected using a high-side switch (612 and 616) form a buck DC/DC converter from the supply voltage to the split voltage (mid-point voltage) and those connected using a low-side switch (614 and 618) form a boost DC/DC converter from the split voltage to the supply voltage.

While connecting an equal number of similar loads (i.e. upper/lower coils, exhaust/intake valves) in either the buck or the boost converter configuration assists in maintaining the required capacitor charge balance, actuator loads may not be exactly equal. In other words, when the total load through the buck converter connected coils matches that through the boost converter connected coils, a natural balance of the split voltage supply will occur. However, since the actuator loads may not be exactly equal, an additional method of maintaining the charge balance (and providing the desired voltage on each of the capacitors), may be needed. Therefore, in one alternative embodiment, a midpoint voltage regulator (MVR) may be used as discussed in more detail below.

Note that the desired voltage across each of the capacitors can be determined by the ratio of the individual stored charge and the capacitance value (V=q/C). This ratio may be chosen to be unity, i.e. equal voltage across each capacitor, or some other value depending on the requirements of the system.

Figure 6A:
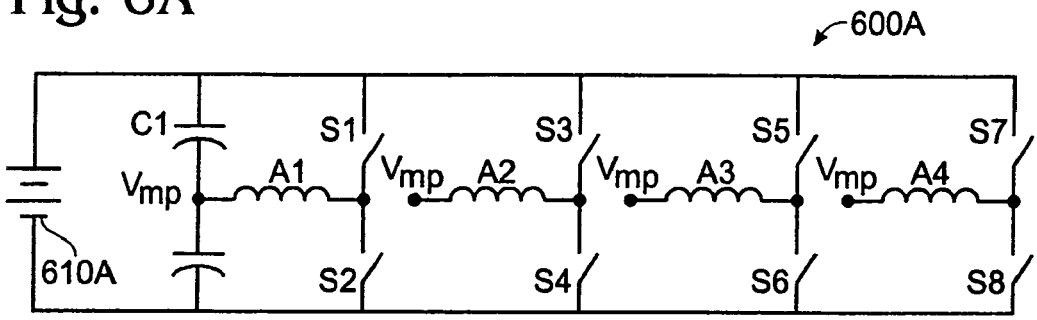
FIGS. 6A-B shows example bi-direction current dual coil converters, and more specifically.

Referring now to FIG. 6A, a diagram shows one embodiment of a bi-directional dual coil half-bridge converter design, which may require a reduced number of power devices and/or gate drive circuits when compared with prior art half-bridge converters (although such half-bridge converters could be used, if desired), while providing the ability for accurate valve control and bi-directional current control. This configuration may therefore result in a significant cost savings for the valve control unit (VCU) of the EVA system. In addition, this example converter may also cut the number of power wires between the VCU and the actuators, which can significantly reduce the wire harness/connectors cost and weight.

Again note that while the examples herein use a dual coil actuator, the converter topology is not limited to dual coil actuators. Rather, it can be used with any system that utilizes multiple actuator coils. Thus, it should be noted that adjacent pairs of converter switches are not necessarily confined to be paired with a single actuators' coils (i.e. each coil of a given actuator may be driven by switches from different legs of the converter), although they may be.

In one example, a split-power supply, which provides a return path for the actuator coil currents, is used. In one example, the split supply could be realized using a pair of batteries. However, this may unnecessarily add cost and weight to the vehicle. Therefore, in another example, a split capacitor bank can be used to transform a single battery into a dual voltage source, as shown in FIG. 6A. Note that a capacitor is an example of an energy storage device, and various types of devices can be used to act as a capacitor or energy storage device.

In the example bi-directional dual coil half-bridge design, each actuator coil may be connected to the split voltage supply through what can be thought of as a DC/DC converter. Operation using a high-side switch forms a buck DC/DC converter from the supply voltage to the split voltage (mid-point voltage), and operation using a low-side switch forms a boost DC/DC converter from the split voltage to the supply voltage.

The coils are actuated and/or deactivated via coordination of their respective switch pair, and the capacitors alternately charge and discharge during the operation of the coils.

Referring now specifically to FIG. 6A, an example converter circuit 600A is shown, with power supply (such as, for example, the vehicle battery) 610A and four actuator coils (A1, A2, A3, and A4). However, any type of power source could be used. Also, in an alternative embodiment, the single voltage source could be replaced with a dual voltage source (i.e. two voltage sources, each placed in parallel across each of the two split capacitors).

In one embodiment, actuators A1 and A2 represent the two coils of an intake valve in a cylinder of the engine, and actuators A3 and A4 represent an exhaust valve of the same cylinder of the engine. In another embodiment, actuators A1 and A2 represent the two coils of an intake valve in a cylinder of the engine, and actuators A3 and A4 represent an intake valve in another (different) cylinder, or the same cylinder, of the engine. Further, in another embodiment, actuators A1 and A2 represent the two coils of an exhaust valve in a cylinder of the engine, and actuators A3 and A4 represent an exhaust valve in another (different) cylinder, or the same cylinder, of the engine. As indicated and discussed below, certain configuration can provide a synergistic result in terms of maintaining a balance of charge in the capacitors.

Continuing with FIG. 6A, eight switches are shown (S1, S2, S3, S4, S5, S6, S7, and S8), with two switches providing current to/from an actuator (e.g., S1 and S2 energizes/de-energizes A1, etc.). Selective actuation of the switches may provide for flyback current (or freewheel current) when deactivating a valve due to the high inductance of the actuator coils. Two capacitors are shown (C1 and C2 are shown). In one example, capacitors C1 and C2 have substantially equal capacitance, however different capacitances can also be used, if desired. This is an example of a split capacitor voltage source (SCVS), where the midpoint voltage can be indicated as $V_{mp}$.

One arrangement would have the four actuator coils be the upper and lower coils for two intake or two exhaust actuators on the same cylinder. In this case, coils A1 and A2 would be the two upper coils of the two actuators and A3 and A4 would be the two lower coils (or vice versa).

Figure 6B:
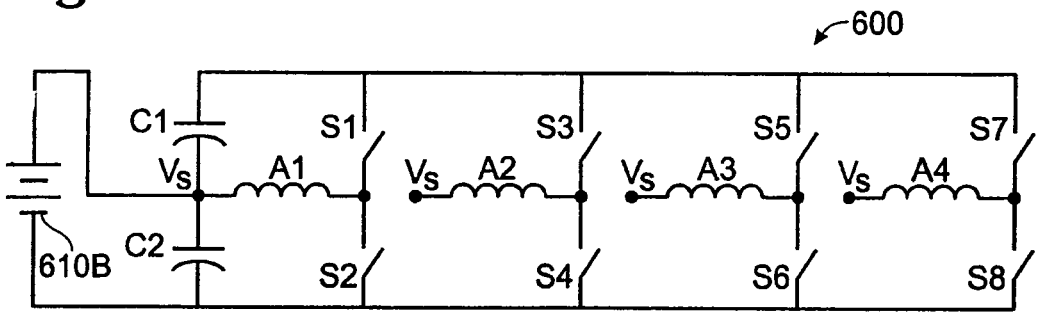

An alternative embodiment can be accomplished by changing the wiring connections between the battery and the capacitors, as shown in FIG. 6B. This alternate circuit configuration may have substantially the same circuit function as the circuit in FIG. 6A. However, one difference in the boosted circuit design of FIG. 6B is the battery is now connected across only one half of the split voltage supply. In one embodiment, the configuration of the coils to aid in maintaining a charge balance using this configuration of the converter may follow the same procedure as described below for the design shown in FIG. 6A. Again, each configuration for the dual coil half-bridge converter may provide substantially similar function, however, the voltage and current rating of the converter components may be different due to the difference in currents and voltages.

Referring now specifically to FIG. 6B, converter 600B is shown with four coils A1-A4. Further, the Figure identifies 4 nodes tied to the output of power supply 610B as $V_s$ (indicating source voltage). One end of each actuator is coupled to a $V_s$ node. Further, each coil has two corresponding switches (S1-S8), with switches S1 and S2 energizing/de-energizing coil A1, etc. In addition, capacitors C1 and C2 are coupled in the converter, with capacitor C2 coupled in parallel with power supply 610G.

Note that while only four actuator coils are shown in FIGS. 6A and 6B, additional stages can be created and cascaded so that all of the valve actuators are included, each with a pair of actuating switches.

Thus, FIGS. 6A and 6B show two versions of bi-directional dual coil converters. These circuits may be derived from the dual coil half bridge converter by replacing the diodes in that converter with active switches and allow bi-directional current control with four quadrant operation. Thus, the example converters of FIGS. 6A and 6B can provide a current versus voltage operating range allowing substantially the same functionality as a full bridge converter, while reducing cost and complexity.

Description of valve initialization during engine start-up, or during engine re-starting (e.g., in a Hybrid-electric vehicle) is described.

Specifically, in any of the above examples, the order of valve initialization during engine start-up can be selected to provide improved charge balance on the converter, if desired. In other words, which of the valves are initialized (before/during rotation), and in what order, can be selected and varied to improve charge balancing, and/or to take into account different operating conditions.

Also, the order of valve initialization can be adjusted based on vehicle and power supply conditions. For example, if the power supply has a higher capacity in some conditions, more valves can be initialized before the engine is rotated by the starting apparatus. Alternatively, if the power supply has a higher capacity in some conditions, less valves can be initialized before the engine is rotated by the starting apparatus.

Figure 7:
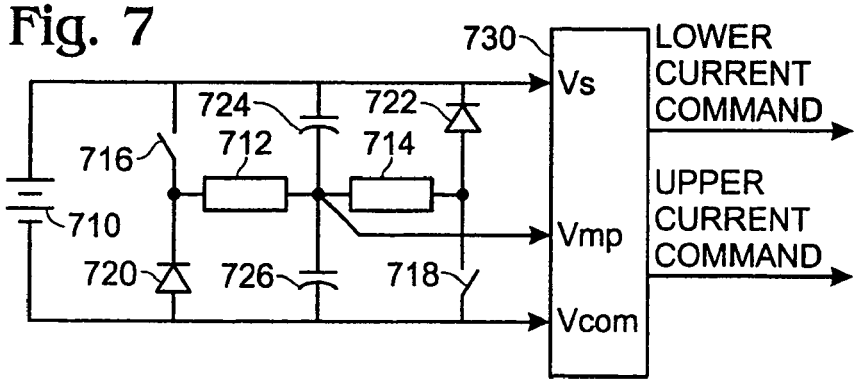
FIG. 7 shows a midpoint voltage regulator circuit (split supply)

Referring now to FIG. 7, an example midpoint voltage regulator (MVR) is shown. In this case, a power supply 710 is shown coupled to a dual coil half bridge converter, which in this example uses only two actuator coils (712 and 714) actuated by switches 716 and 718, respectively. As above, diodes 720 and 722 are also present. In this embodiment, the MVR (730) maintains a desired ratio voltage across each of the capacitors (e.g., 724 and 726 in FIG. 7). This is accomplished by monitoring the supply and midpoint voltages, and then performing a regulation function that keeps the midpoint (MP) voltage at a desired level (which can vary with engine and or cylinder operating conditions).

In one example, the regulation can be accomplished by exploiting the inherent buck and boost converter actions, described above. Specifically, by commanding additional buck action when the MP voltage gets too low (and/or additional boost action when the MP voltage gets too high) a mechanism for providing the regulation function can be implemented.

One method that can be used to implement a midpoint voltage regulator is to add an additional buck/boost DC/DC converter in parallel with the dual coil half-bridge converter, whose purpose is to provide a regulation function, although it can be used for other functionality, if desired. While this approach can achieve the desired result, it may unnecessarily waste energy in its operation. Therefore, in an effort to improve overall operation, an alternative embodiment uses another form of a midpoint voltage regulator. Specifically, this alternative midpoint voltage regulator uses the actuator coils (the dual coil half-bridge converter) to implement the desired regulation. This is achieved, as described below, without compromising the primary current control function of the converter.

Note that in many applications, midpoint voltage regulation using the actuator coils may not be possible because each of the loads (actuators) on the converter would be required to follow a current command that cannot be varied for any ancillary purposes. However, in the application for engine cylinder valve actuation, actuator current regulation may be required to follow a specific command under some conditions (such as specific transient periods of operation). But, under other conditions, actuator current can vary within a larger range from the desired value. Recognition of this allows synergistically exploitation of the circuit structure to enable midpoint voltage regulation without unnecessarily wasting energy. In other words, this may provide the opportunity to interleave midpoint voltage regulation within the normal actuator current control function.

Figure 8:
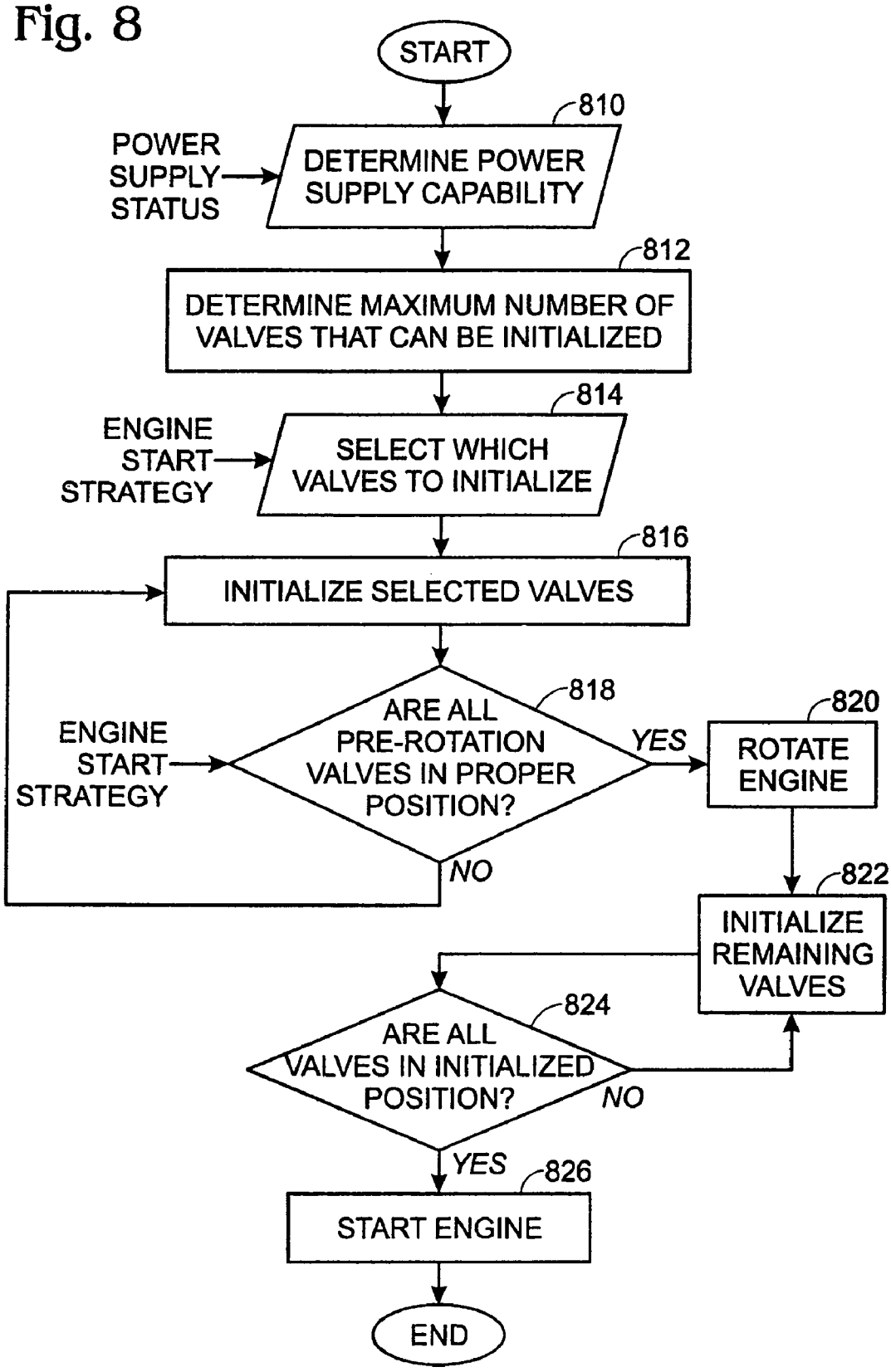
FIGS. 8, 9, 11, and 12 show high level flowcharts of routines that may be used to control engine operation.

The flowchart in FIG. 8 shows one example approach for the initialization of engine valves when a half-bridge converter is used, although it can be used with other converter topologies as well.

In step 810 the routine determines example power supply capabilities based on current operating conditions, such as ambient temperature, battery state of charge, engine temperature, battery life, or combinations thereof. Then, in step 812, the routine determines the number of electromechanically actuated valves that can be simultaneously actuated, due to the status of the vehicle power supply system, and valve actuator operating conditions, before the engine is rotated. This determination may be made based on, but not limited to, voltage, temperature and battery state of charge, valve actuator impedance, or combinations thereof. The relationship between the power supply status and the number of valves that can be initialized may be a calibratable quantity and may be implemented in the algorithm as a look-up table, a fixed mathematical relationship, etc.

Figure 9:
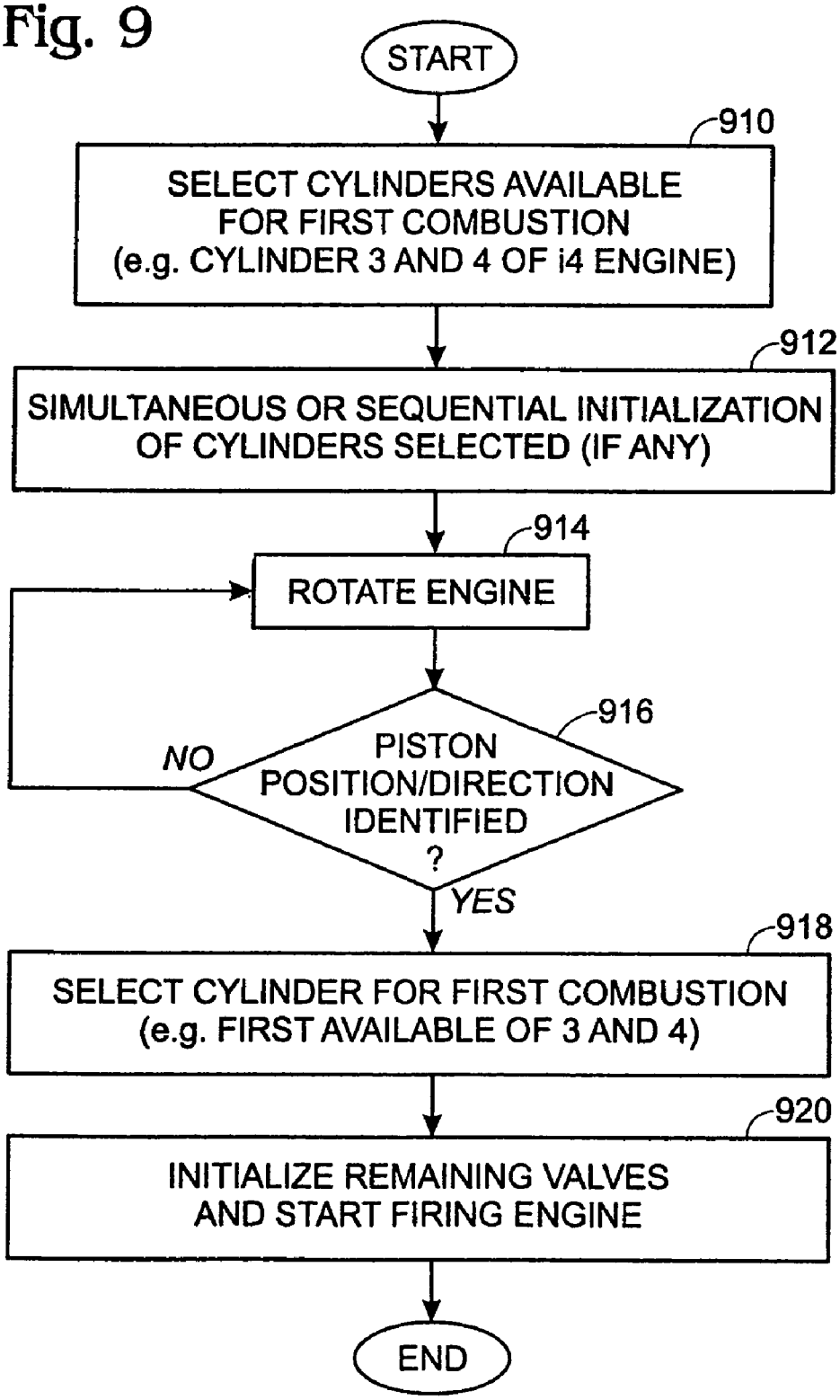
Figure 9A:
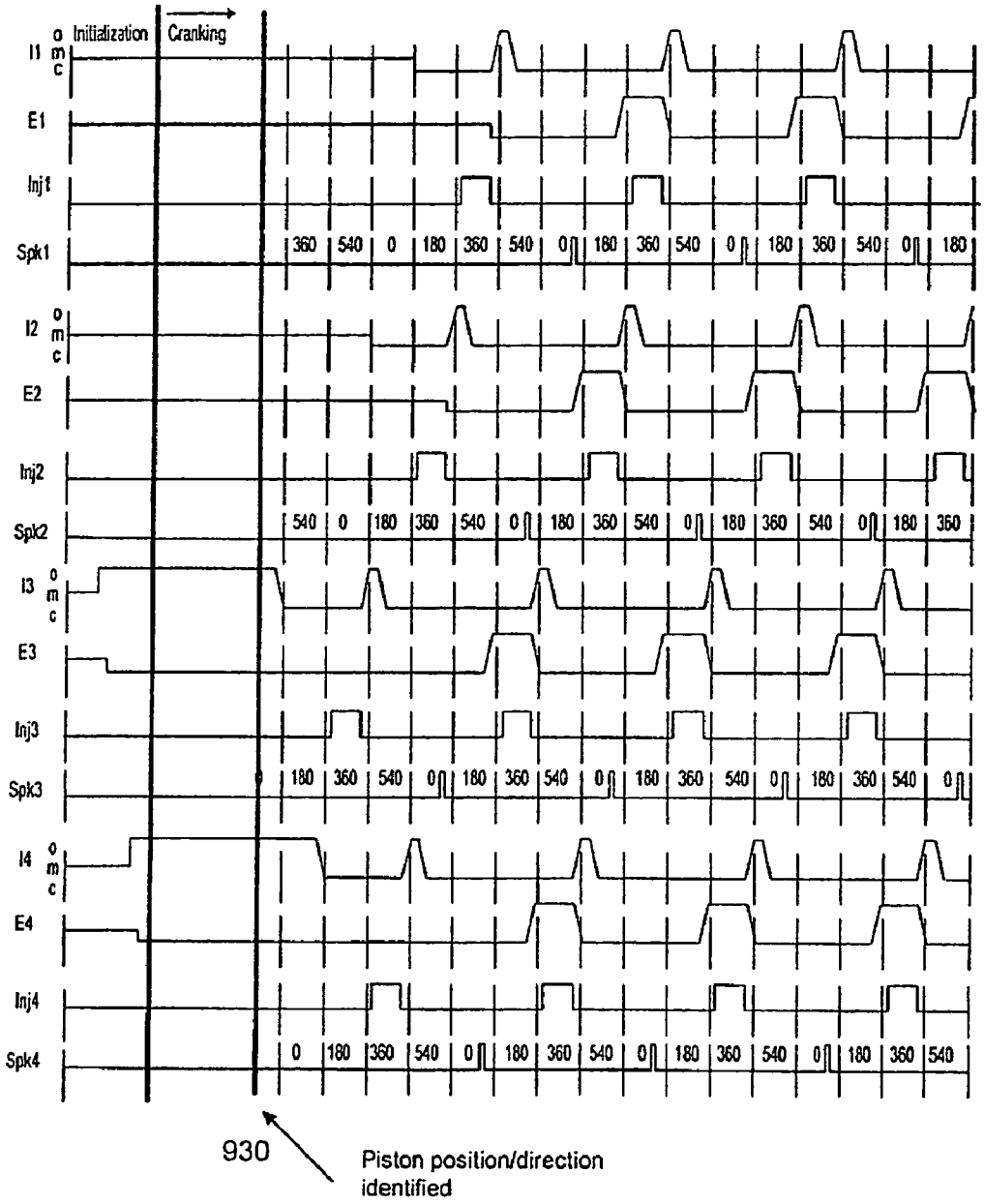
Figure 9B:
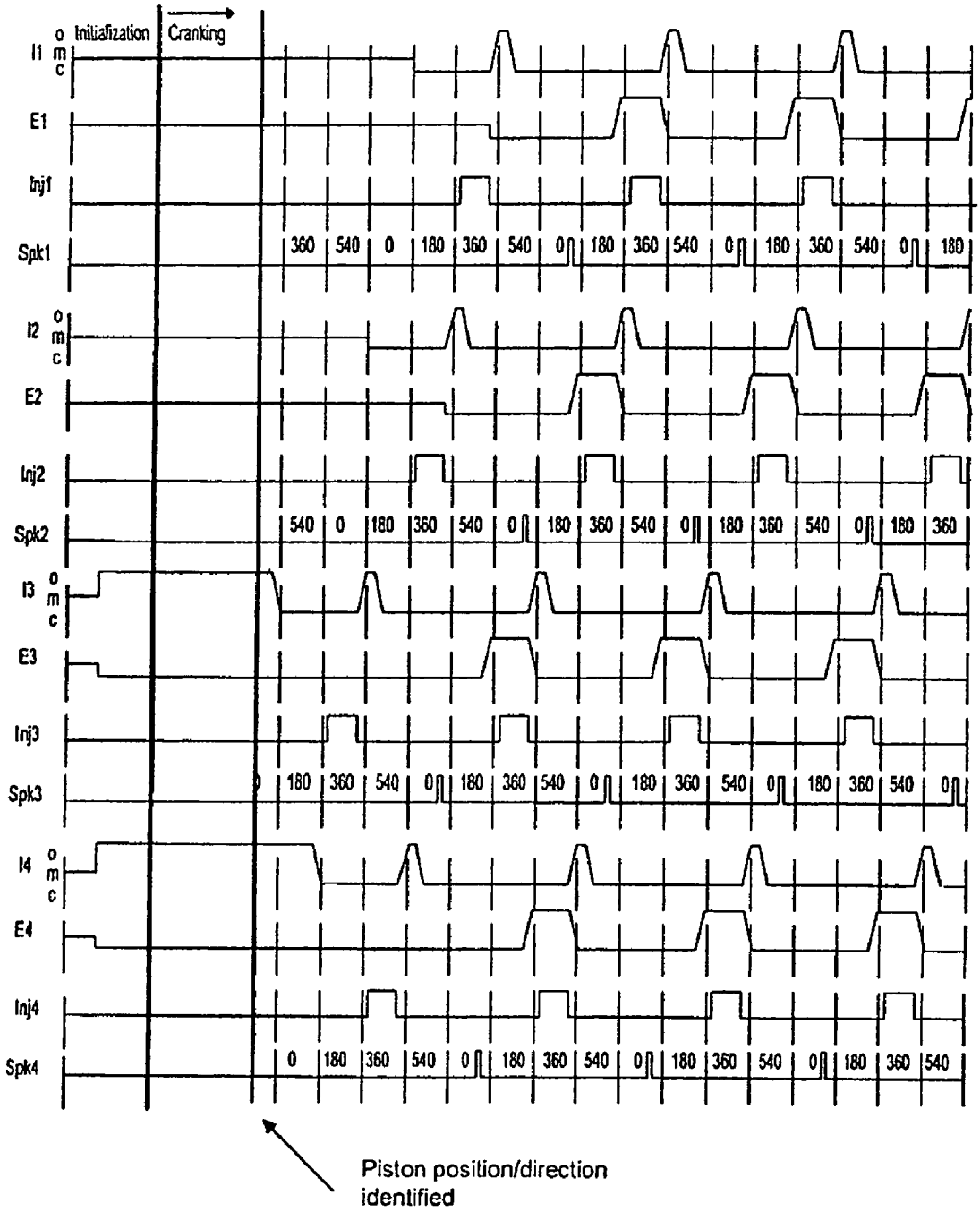

Note that in step 812, the number of electromechanically actuated valves that can be simultaneously actuated is determined for the case where valves are simultaneously actuated before the engine rotates, such as illustrated in FIG. 9B, for example. This may reduce engine starting time, in some examples. However, in an alternative approach, valves initialized before engine rotation may be sequentially initialized to reduce instantaneous power consumption, as shown in FIGS.

8A and 8B, for example. Also, in one example, the number determined in step 812 may represent the maximum number of valves that the power supply has the capability of initializing, or alternatively zero.

Specifying the initialization of zero valves before engine rotation may further reduce starting time. If driver requests reduced starting time by requesting engine rotation, without substantial delay (0-5 seconds), after a key or power on condition, starting time may be reduced by initializing valves during engine cranking. Since valve timing is based on engine position, and since engine position is usually determined during cranking, the period between the beginning of engine cranking and where engine position is determined, may be used to initialize valves and further reduce delay time before cranking.

Once the number of valves is determined in step 812, the routine selects the particular valves to initialize based on the engine strategy, for example, in step 814. In one example, the valves selected to be initialized are selected to initialize intake valves first, or initialize exhaust valves first, or initialize intake and exhaust valves simultaneously, or initialize the valves on particular cylinders before rotating engine, or combinations thereof.

In one particular example where a 4 cylinder engine is used, two cylinders are selected for initialization having pistons in different locations. In this way, the first cylinder to carry out combustion can be selected from these two cylinders to enable improved starting time, since depending on where the engine stopped, one of these two cylinders will be available for a first combustion earlier than the other due to the different piston positions. This is described in more detail below with regard to FIG. 9A, for example.

Continuing with FIG. 8, the routine then initializes the selected valves in step 816 before the engine is rotated by an engine starting apparatus, such as a starter motor driven by the vehicle battery.

As noted in FIG. 8, engine strategy parameters may also be used to coordinate the beginning of engine rotation with the initialization of the valves. This may be beneficial since it allows the engine rotation to begin before any or all of the electromechanically actuated valves have been initialized, thereby potentially reducing the startup time and allowing the engine to be spun up to starting speed with a lower compression (reduced starting torque required). In other words, since the engine is rotated with at least some valves still in a mid-position (rather than in a closed position), less energy may be required to rotate the engine since for at least those cylinders, the piston may not have to compress air against closed valves.

Continuing with FIG. 8, in step 818 the routine determines whether all of the pre-rotation valves selected in step 814 have been initialized. If so, the routine continues to step 820 to rotate the engine under power of the starting apparatus (e.g., starter motor, integrated starter alternator, etc). Otherwise, the routine returns to step 816.

From step 820, the routine continues to step 822 to initialize the remaining valves, and then proceed to step 824 to determine whether all electromechanical valves are in the desired position. If not, the routine returns to step 822. If so, the routine continues to step 826 to start the engine, e.g., start the engine by injecting fuel and igniting it in a combustion stroke of the engine.

In one example where valves of some cylinders are initialized before rotation, and the valves of other cylinders are initialized after rotation, the initialization of the remaining valves in step 822 is performed to set the stroke of the remaining cylinders to the proper stroke to provide the desired firing order of the engine.

This starting approach can be illustrated in various example plots showing starting sequences that may be used. For example, referring to FIG. 8A, a timing diagram for an example embodiment is illustrated for an I-4 engine, with four cylinders each having an electromechanically driven intake and exhaust valve, and with a firing order of 1-3-4-2 (not that cylinder 1 is always the first to fire during starting, although it may be). Timing diagrams of intake (I), exhaust (E), fuel injection (Inj), and spark (spk) are shown for each cylinder, starting with cylinder 1 at the top and cylinder 4 at the bottom. The numbers embedded along side of each cylinder spark timing trace indicate the engine position with respect to top-dead-center (TDC) of the combustion stroke. Each number corresponds to the timing mark to the right of the number.

Figure 8A:
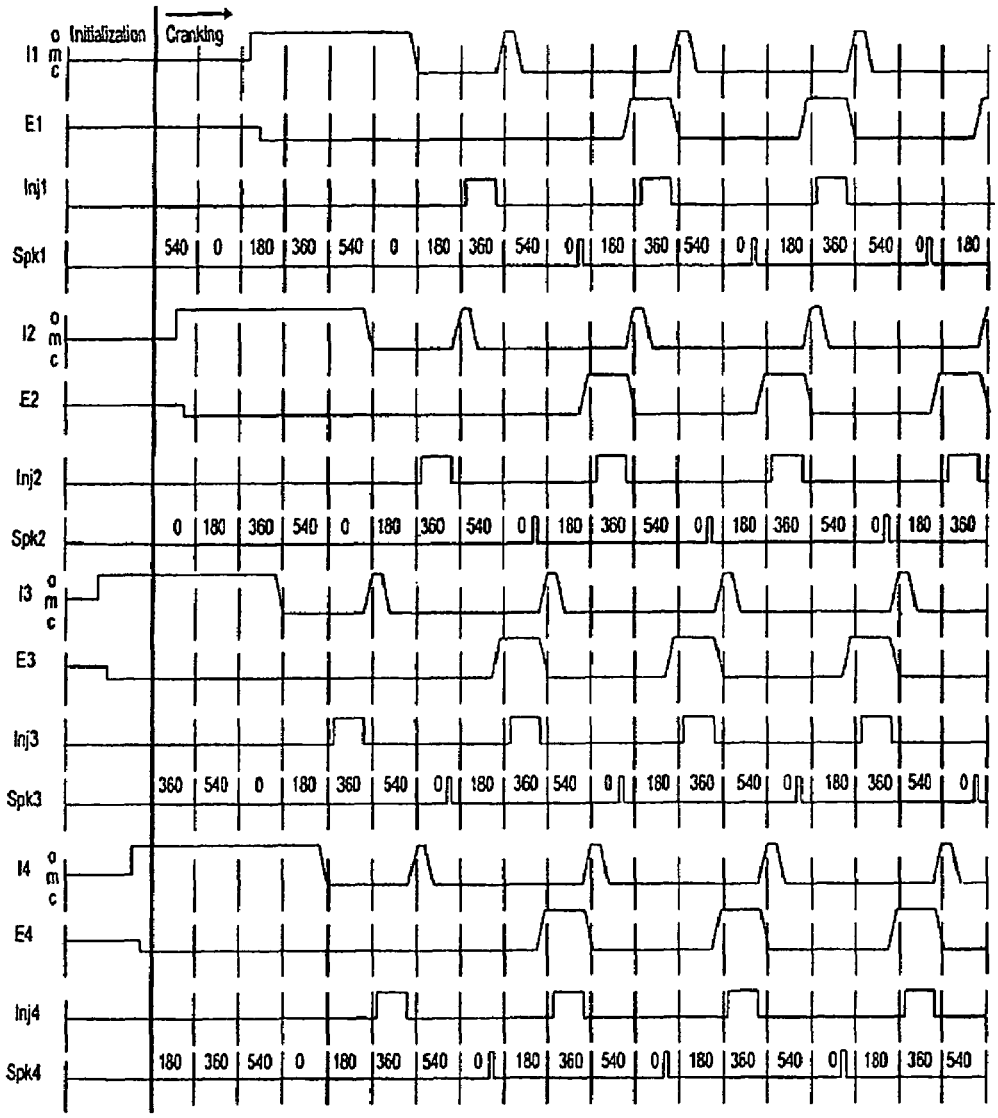
FIGS. 8A, 8B, 9A, 9B, 9C, 9D, 10A, and 10B, are various alternative embodiments of engine valve timing that may be used.

FIG. 8A shows an embodiment (following the routine of FIG. 8) where sequential valve initialization is used both before and after cranking, although simultaneous valve initialization may be used either before or after cranking, or both. Further, FIG. 8A illustrates initializing some valves to an open position (intakes), and some valves to a closed position (exhausts), although various combinations and alternatives to this approach may be used. For example, some cylinders (those being initialized after cranking) can have intake and exhaust valves initialized open, while others (those being initialized before cranking) can have intake valves initialized open and exhaust valves initialized closed. Or, some cylinders (those being initialized before cranking) can have intake and exhaust valves initialized open, while others (those being initialized after cranking) can have intake valves initialized open and exhaust valves initialized closed. In still another example, all valves can be initialized open or closed. In yet another example, some valves can be initialized to a closed position (intakes), and some valves to an open position (exhausts).

FIG. 8A illustrates that before cranking, valves in cylinders 3 and 4 are sequentially initialized, and then after cranking, valves in cylinders 1 and 2 are initialized. Also, fuel injection and spark timings are illustrated relative to valve timings.

Note that the timing diagram of FIG. 8A can be modified in a variety of ways. As just one example, cylinders 1 and 3 can be initialized before rotation and 2 and 4 initialized after rotation. Also, FIG. 8A illustrates injecting fuel on a closed intake valve, although open intake valve injection can also be used, or combinations of open/closed intake valve injection can be used.

In the example illustrate in FIG. 8A, intake valves are initialized open to reduce pumping work in cranking the engine, while exhaust valves are initialized closed to reduce residual fuel (hydrocarbons) from being emitted through the exhaust. Since during cold starting the catalyst may be cool, reducing these emitted hydrocarbons may reduce emitted emissions, thereby improving emission control. Further, since the intake valve may be maintained open through more than an intake stroke, pumping work is still reduced, even though the exhaust valve is maintained closed before a first combustion event in that cylinder.

In general terms, in the example illustrate in FIG. 8A, first cylinders 3 and 4 are sequentially initialized to move the intake valves open and the exhaust valves closed. Then, the engine is rotated via a starting motor, or other device such as a starter-alternator, or a motor of a hybrid vehicle. This is termed "cranking." Then, during what would be an exhaust stroke of cylinder 3, the intake valve of cylinder 3 may be closed to enable closed valve fuel injection during starting. The timing of the closing of intake valve 3 can be varied (based on operating conditions, for example) to affect the amount of air that is subsequently inducted during the intake stroke after fuel injection. However, compressing an air charge and then opening an intake valve may cause air to be pushed back into the intake manifold during the intake stroke. In some cases, this may push injected fuel into the intake manifold, resulting in increased starting time. In other words, the timing of the closing of the intake valve may affect the cylinder pressure (vacuum) present when the intake valve is opened to commence the first intake stroke. Therefore, by adjusting this timing, the amount of air inducted can be varied.

Subsequently, this process is repeated for each of the cylinders in the firing order.

Figure 8B:
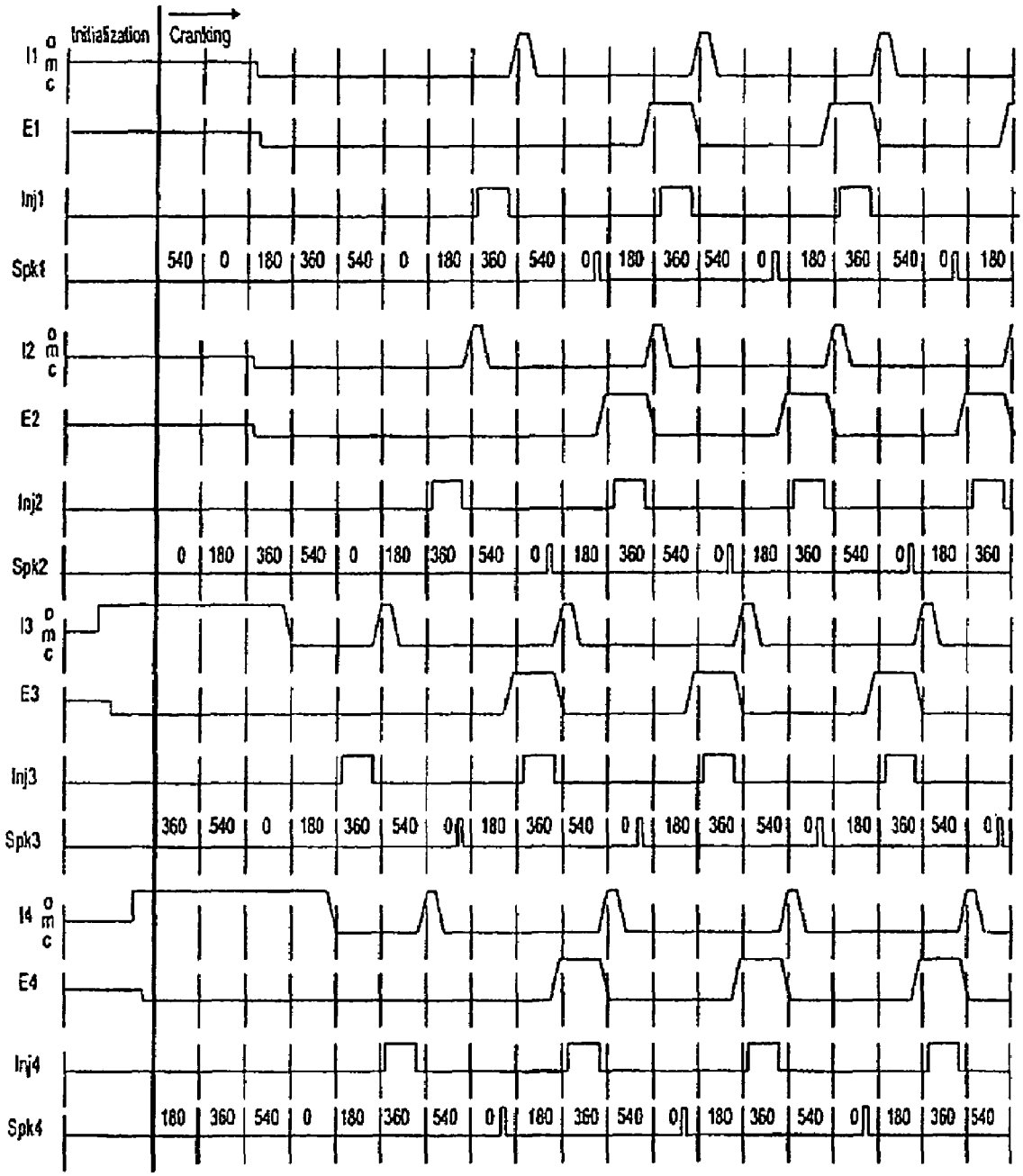

FIG. 8B show an alternative embodiment following the routine of FIG. 8 where sequential valve initialization is used before rotating the engine, and simultaneous valve initialization is used after rotating the engine. Also, the sequential initialization in this example moves both the intake and exhaust valves of cylinders one and two to a closed position. The timing of this initialization may affect the amount of air inducted during the subsequent first intake stoke, and thus can be varied to provide a desired amount of air on the first intake stroke for those cylinders.

The remainder of FIG. 8B is similar to that of FIG. 8A, and can also include any or all of the modifications or alternatives discussed herein with regard to FIG. 8A.

Referring now to FIG. 9, an alternative routine for initializing electromechanically actuated cylinder valves of the engine is described. First, in step 910, the routine selects the cylinders which will be the available cylinders to carry out the first combustion event in the engine. For example, in the case of an I4 engine, the routine can select two cylinders having the piston in different relative locations. For example, routine could select cylinders 1 and 2, or 1 and 3, or 2 and 4, or 3 and 4. To illustrate example operation, it can be assumed that in this example, cylinders 3 and 4 are selected to be the cylinders available to perform the first combustion event.

Next, in step 912, the routine selects whether simultaneous or sequential initialization of cylinder valves is selected. Note, as discussed above herein, either initialization approach can be used, or combinations thereof can be used. Next, in step 914, the routine initiates rotation of the engine.

Next, in step 916, the routine determines whether piston position/direction has been identified from the engine crank sensor, for example. If not, the routine continues to monitor crank position to identify the engine/piston position and/or direction. Once piston position has been identified, the routine continues to step 918. In step 918, the routine selects a cylinder to carry out first combustion from the cylinders identified as being available in step 910. Thus, for the example described above where cylinders 3 and 4 are selected as the available cylinders, the routine determines in step 918, based on piston position and/or direction of piston movement, which of cylinders 3 and 4 will be the cylinder first able to carry out combustion. In one example, this selection may be based on which cylinder has a piston moving downward with sufficient piston travel remaining to be able to induct sufficient air to carry out a first combustion event.

From step 918, the routine continues to step 920 to initialize the remaining cylinder valves and start firing the engine. These can be performed together or the valves can be first initialized, and then engine firing began.

An example timing diagram to illustrate operation according to the approach of FIG. 9 is illustrated in FIG. 9A. The timing diagram of FIG. 9A illustrates example operation for the case where the cylinders selected to be available for first combustion are cylinders 3 and 4. Those well skilled in the art will realize that it can be modified for any of the above various alternative approaches.

As illustrated in FIG. 9A, before engine cranking (during initialization), each of the intake and exhaust valves of cylinders 3 and 4 are sequentially moved to a desired position. In the next example, the intake valves are moved to an open position and the exhaust valves are moved to a closed position. However, in alternative embodiments, all of the valves may be moved to an open position, a closed position, or various other combinations thereof. For example, the intake valves can be moved to a closed position while the exhaust valves are moved to an open position, or both the intake and exhaust valves of cylinder 3 can be moved to open positions, while both the intake and exhaust valve of cylinder 4 can be moved to closed positions.

After engine cranking is commenced, then piston position/direction is identified at the location indicated by the arrow 930. At this point, the routine has identified that cylinder 3 may be the first cylinder able to perform a sufficient intake stroke to induct sufficient air to carry out first combustion event. Therefore, the routine sets the stroke of each of cylinders 3 and 4 (which also sets the stroke of the remaining cylinders), and adjusts the valves to the desired stroke timing. Specifically, the routine sequentially sets each of the intake and exhaust valves of cylinders 3 and 4 to the desired positions to create intake, compression, power, exhaust strokes with the appropriate fuel injection and spark timing to prolong a first combustion event in cylinder 3 followed by combustion in cylinder 4.

During the setting of the strokes of cylinders 3 and 4, along with moving the valves to desired positions for cylinders 3 and 4, the routine also initializes the valves sequentially in cylinders 1 and 2. Note that in this way, the initialization of at least some valves in cylinders 1 and/or 2 may occur after the engine has been fired first in cylinder 3. In this way, it may be possible to reduce the initial initialization time before engine cranking. Further, at the same time, it may be possible to reduce power consumption by the battery during cranking since at least some valves can be initialized after the engine has performed at least some combustion, thereby reducing the loading of the starting apparatus.

Note that the timing diagram of FIG. 9A is merely exemplary in nature, and can be modified in various ways. For example, the initialization of the valves for cylinders 1 and 2 can be performed at a variety of times earlier or later than that illustrated in FIG. 9A. For example, the exhaust valves (E1 and E2) can be left in the mid position for a greater duration that that illustrated. Likewise, the intake valves (I1 and I2) can be simultaneously initialized, and/or initialized at an earlier duration than that illustrated in FIG. 9A.

Figure 9C:
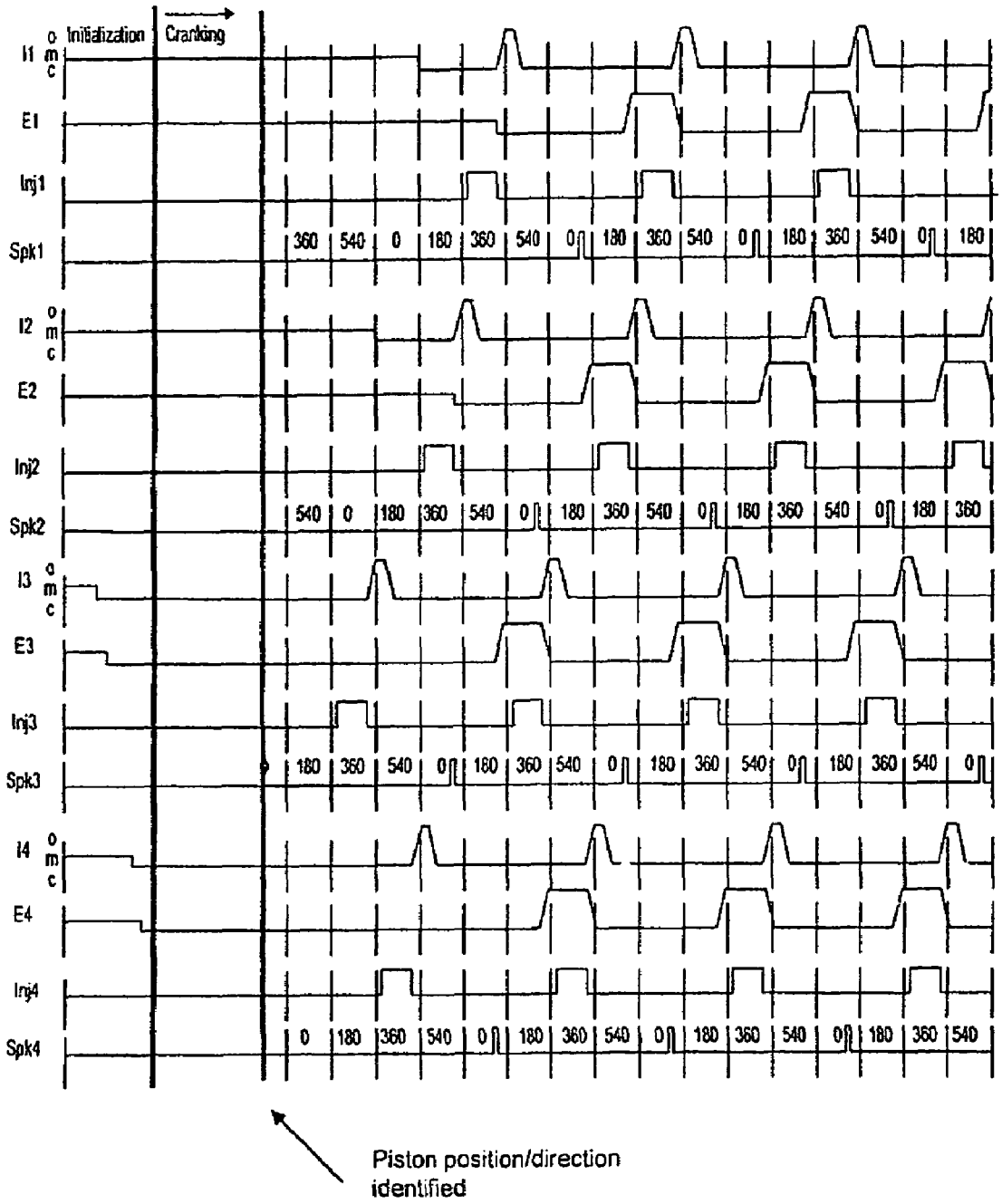

Still further variations are illustrated in the timing diagrams of FIGS. 9B and 9C. For example, FIG. 9B illustrates simultaneous initialization of the intake and exhaust valves of cylinders 3 and 4, while FIG. 9C illustrates sequential initialization of the intake and exhaust valves for cylinders 3 and 4 to close positions.

Referring back to FIG. 9A, further details of the example timing diagram embodiment are illustrated following the routine of FIG. 9. As noted above, in this example, two cylinders are selected to be available for a first combustion event (cylinders 3 and 4). These two cylinders have their valves sequentially initialized before rotating the engine, while remaining valves are sequentially initialized after rotation. Also, as discussed above with respect to FIGS. 8A and 8B, closed intake valve fuel injection is used where at least some fuel is injected while an intake valve for that injector is closed.

As illustrated in FIG. 9A, cylinders 3 and 4 have their valves sequentially initialized before engine rotation. Then, after rotation begins, at 930, engine position is identified so that it is possible to determine engine piston location and direction of travel. From this information, the routine above identifies which of cylinders 3 and 4 is available to first carry out combustion by inducting a sufficient amount of air with injected fuel. In this example, cylinder 3 is in position for the first combustion. Thus, before the intake stroke, the intake valve of cylinder 3 is moved to a closed position. As above, the timing of this movement can be selected to affect the amount of air inducted. Then, during the closed intake valve timing, fuel may be injected and the valve timing for four-stroke operation is set and follows. In this example, the exhaust valves of cylinders 3 and 4 are maintained closed after initialization until a first combustion in the respective cylinder for the valve.

Once one of cylinders 3 and 4 is identified to carry out a first combustion event, the remaining valve timings may be set to provide the desired firing order, 1-3-4-2 in this example, although others can be used if desired.

In this example, the valve initialization of cylinders 1 and 2 may be delayed until after engine rotation begins, and potentially after firing of one of cylinders 3 and 4. Specifically, once the timing of cylinder 3 is set, the initialization of cylinders 1 and 2 can be determined. Again, closed intake valve injection may be used. Further, the initialization of the exhaust valve (or intake valves) to a closed or open position in cylinders 1 and/or 2 can also be varied (based on operating conditions such as temperature) or delayed to reduce current usage during engine cranking. As shown in FIG. 9A, movement of valves in cylinder 1 may be delayed until after combustion occurs in cylinder 3, thereby enabling reduced power draw since engine combustion may now be partially rotating the engine. In this way, reduced starting time may be achieved (since only some of the valves may be initialized before rotation of the engine), while still reducing power usage.

Figure 9D:
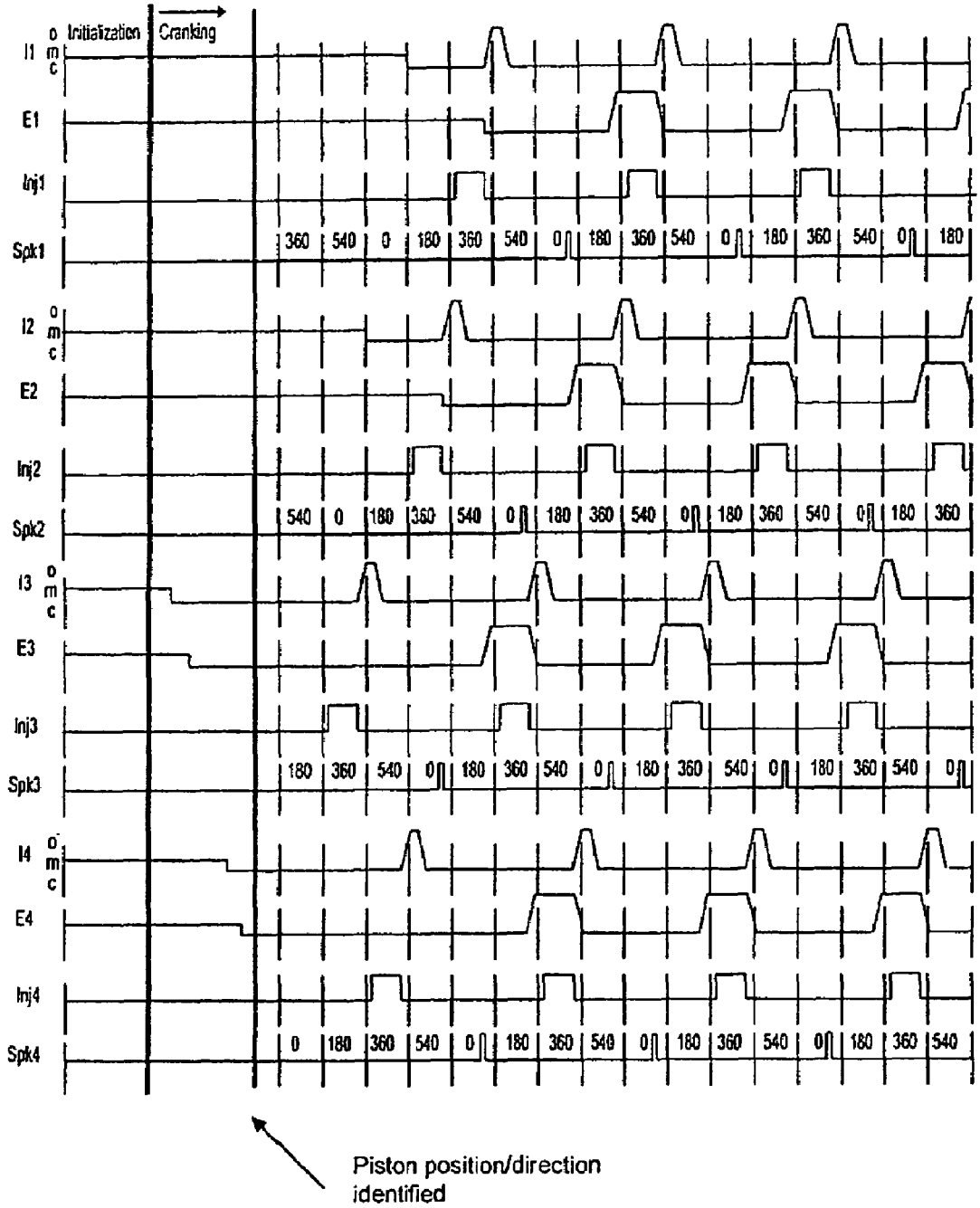

FIG. 9B shows an alternative embodiment similar to that of FIG. 9A, except that simultaneous valve initialization is utilized before engine rotation. FIG. 9C also shows yet another alternative similar to that of FIG. 9A, except that valves are initialized closed before rotation, rather than intakes moved open and exhausts moved closed. FIG. 9D shows still another alternative embodiment wherein valve initialization occurs after engine rotation has begun. Of course this embodiment may also include the above and below mentioned valve initialization positions.

Figure 10A:
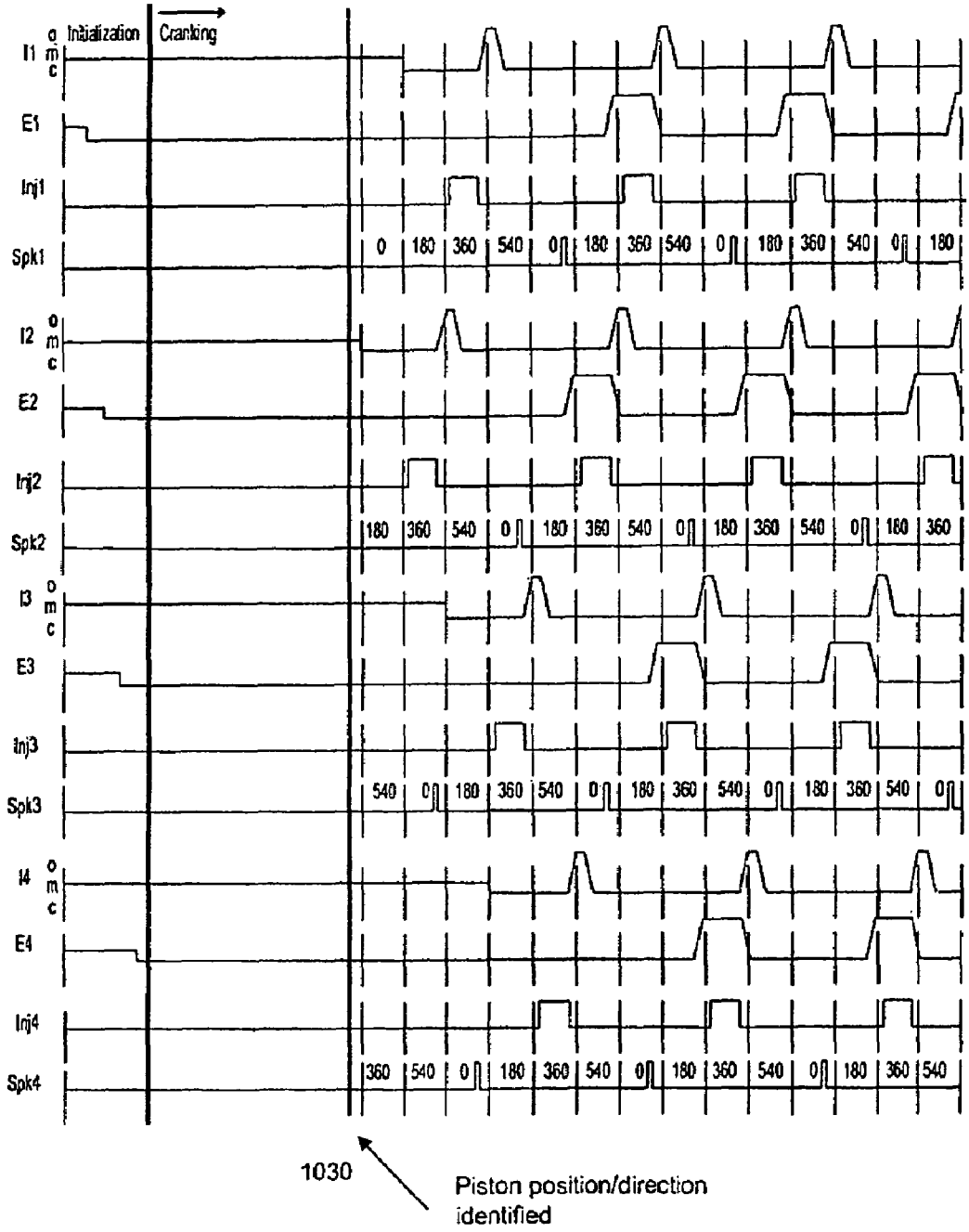

As indicated above, still further variations may be used. For example, FIG. 10A illustrates the case where the intake valves for cylinders 1 through 4 are initialized after engine cranking, while the exhaust valves of cylinders 1 through 4 are initialized sequentially before cranking. Alternatively, the exhaust valves of cylinders 1 through 4 can be simultaneously initialized. Specifically, in the embodiment of FIG. 10A, exhaust valves of each of cylinders 1, 2, 3, and 4 are sequentially initialized closed before engine rotation, and then intake valves are sequentially initialized after engine rotation. Again, simultaneous initialization may be used in an alternative embodiment.

While FIG. 10A shows exhaust valves for cylinders 1 through 4 sequentially initialized, they may be initialized in any order. Then, after engine rotation begins, the controller identifies at 1030 engine position, such as piston position, piston direction, crank position, or combinations thereof. At this point, the controller determines that cylinder 2 is in a position to carry out a first combustion event. Based on this, the intake valve of cylinder 2 is initialized (closed in this case for closed intake valve injection is used, although in an alternative embodiment, it may be initialized open). Based on this, the remaining strokes of each cylinder can be determined and valve timing set accordingly. In this example, exhaust valves are maintained closed after initialization until a first combustion event in the respective cylinder of the valve. Also, in each cylinder, the timing of the initial moving of the intake valve away from the mid position can be adjusted to affect the amount of fresh air drawn in during the subsequent first intake stroke.

In the example illustrated in FIG. 10A, engine starting time may be reduced since only some of the valves may be initialized before engine rotation. Further, while some valves may be initialized during cranking, battery draw may still be reduce in some cases since the engine pumping work may be reduced due to the partially open intake valves in the mid position. As such, improved starting may be achieved.

Figure 10B:
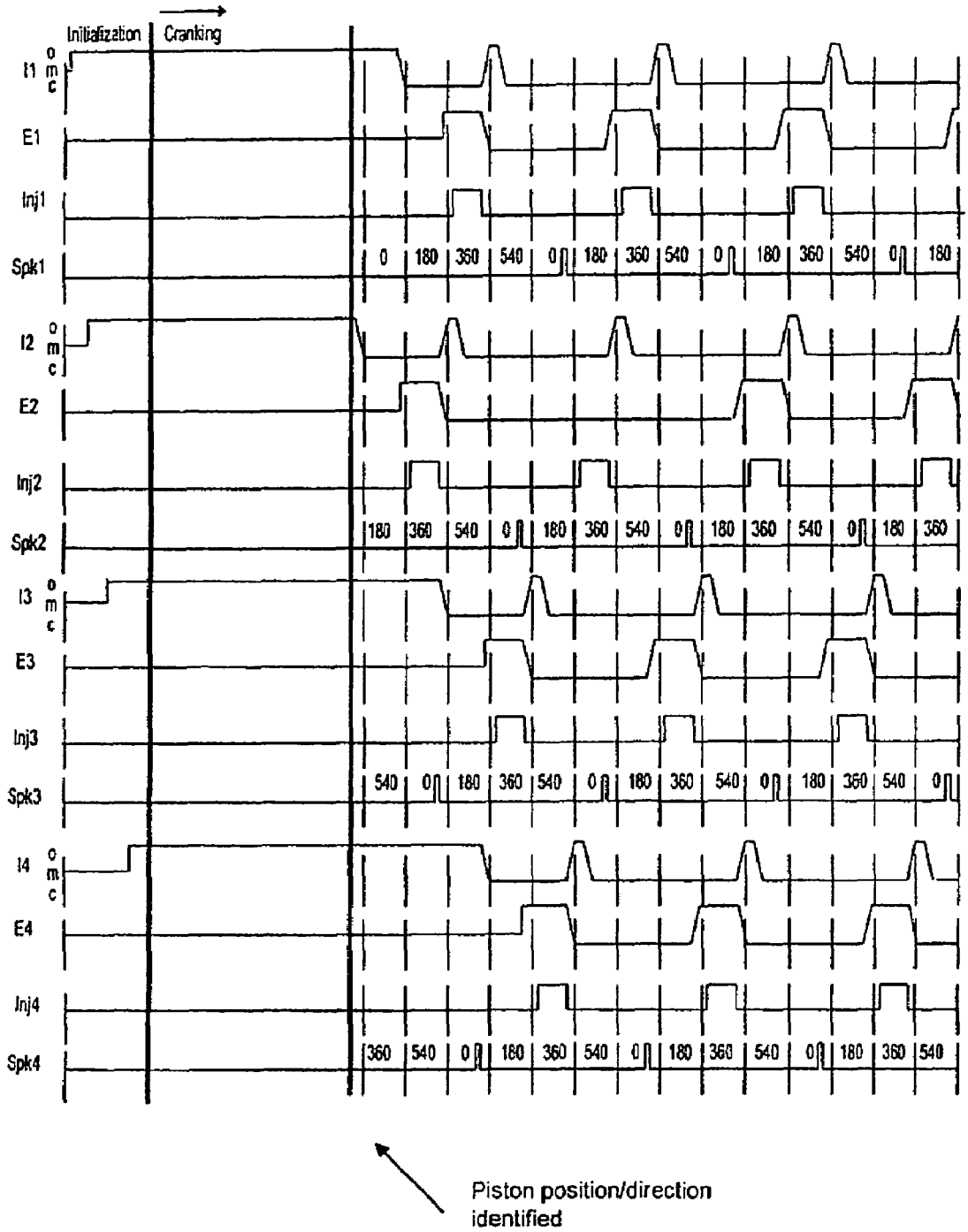

Still another alternative embodiment is illustrated in the timing diagram of FIG. 10B. This example is similar to FIG. 10A, except that intake valves are sequentially initialized before engine rotation, and exhaust valves are initialized after rotation. Specifically, in FIG. 10B, all of the intake valves of cylinders 1 through 4 are initialized sequentially to an open position before engine cranking, while exhaust valves of cylinders 1 through 4 are initialized after engine cranking. Again, simultaneous initialization may also be used.

While the above examples illustrate operation according to the embodiment where two valves per cylinder of an I-4 engine are used, they can be applied to other engine types such as, for example: V-6 engines, I-6 engines, V-8 engines, V-10 engines, V-12 engines and various others. Likewise, they may be applied to engines having 1 electromechanical valve per cylinder, 2 electromechanical valves per cylinder, 3 electromechanical valves per cylinder, and/or 4 electromechanical valves per cylinder, or combination thereof.

Figure 11:
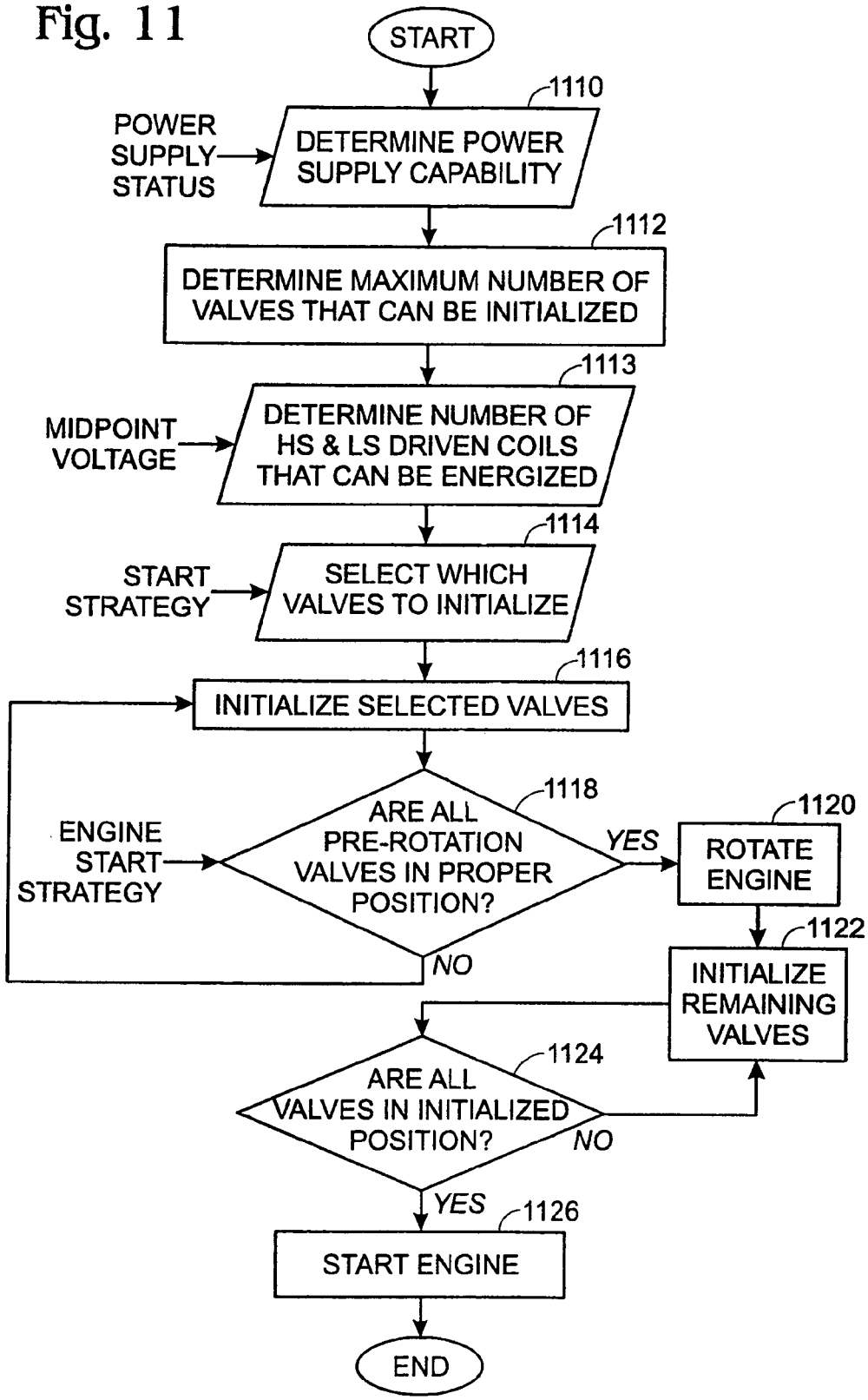

The flowchart in FIG. 11 shows an alternative embodiment for the initialization of engine valves when a split supply converter is used, although it can be used with other converter topologies as well.

The flowchart shown in FIG. 11 describes an initialization strategy that may be used when a split supply dual coil half-bridge converter topology is used. The process is similar to that of the example half bridge approach of FIG. 8, except that an additional step (1113) is included that restricts which valves can be initialized so that the split power supply voltages may be maintained at their desired level. This may be accomplished by initializing the proper number of high-side (HS) and low-side (LS) driven coils such that the midpoint voltage moves closer to the desired value. The relationship between the midpoint voltage and the number of HS and LS driven coils that can energized may be a calibratable quantity and can be implemented in the algorithm as a look-up table, a fixed mathematical relationship, etc. Although not shown in the flowchart, a separate midpoint voltage regulator may also be implemented that continually works to regulate the midpoint voltage. This midpoint regulator, which can operate any time the EVA system is active, can function differently during a startup process than it does during other engine operations, since the number of coils available for it to maintain the midpoint voltage is further restricted by whether the valves associated with those coils have been initialized.

In general terms, the midpoint voltage regulator uses a proportional integral controller to adjust the midpoint voltage to a desired value.

Referring now specifically to FIG. 11, in step 1110 the routine determines example power supply capabilities based on current operating conditions, such as ambient temperature, battery state of charge, engine temperature, battery life, or combinations thereof. Then, in step 1112, the routine determines the number of electromechanically actuated valves that can be simultaneously actuated, due to the status of the vehicle power supply system, and valve actuator operating conditions, before the engine is rotated. This determination may be made based on, but not limited to, voltage, temperature and battery state of charge, valve actuator impedance, or combinations thereof. The relationship between the power supply status and the number of valves that can be initialized may be a calibratable quantity and may be implemented in the algorithm as a look-up table, a fixed mathematical relationship, etc. Furthermore, zero valves may be selected for initialization before engine cranking to further reduce starting time.

Once the number of valves is determined in step 1112, the routine determines the number high side (HS) and low side (LS) driven coils that can be initialized while provided a desired midpoint voltage range. Then, the routine selects the particular valves to initialize based on the engine strategy, for example, in step 1114, and the determinations of steps 1110-1113.

Continuing with FIG. 11, the routine then initializes the selected valves in step 1116 before the engine is rotated by an engine starting apparatus, such as a starter motor driven by the vehicle battery. In step 1118 the routine determines whether all of the pre-rotation valves selected in step 1114 have been initialized. If so, the routine continues to step 1120 to rotate the engine under power of the starting apparatus (e.g., starter motor, integrated starter alternator, etc). Otherwise, the routine returns to step 1116.

From step 1120, the routine continues to step 1122 to initialize the remaining valves, and then proceed to step 1124 to determine whether all electromechanical valves are in the desired position. If not, the routine returns to step 1122. If so, the routine continues to step 1126 to start the engine, e.g., start the engine by injecting fuel and igniting it in a combustion stroke of the engine.

Figure 12:
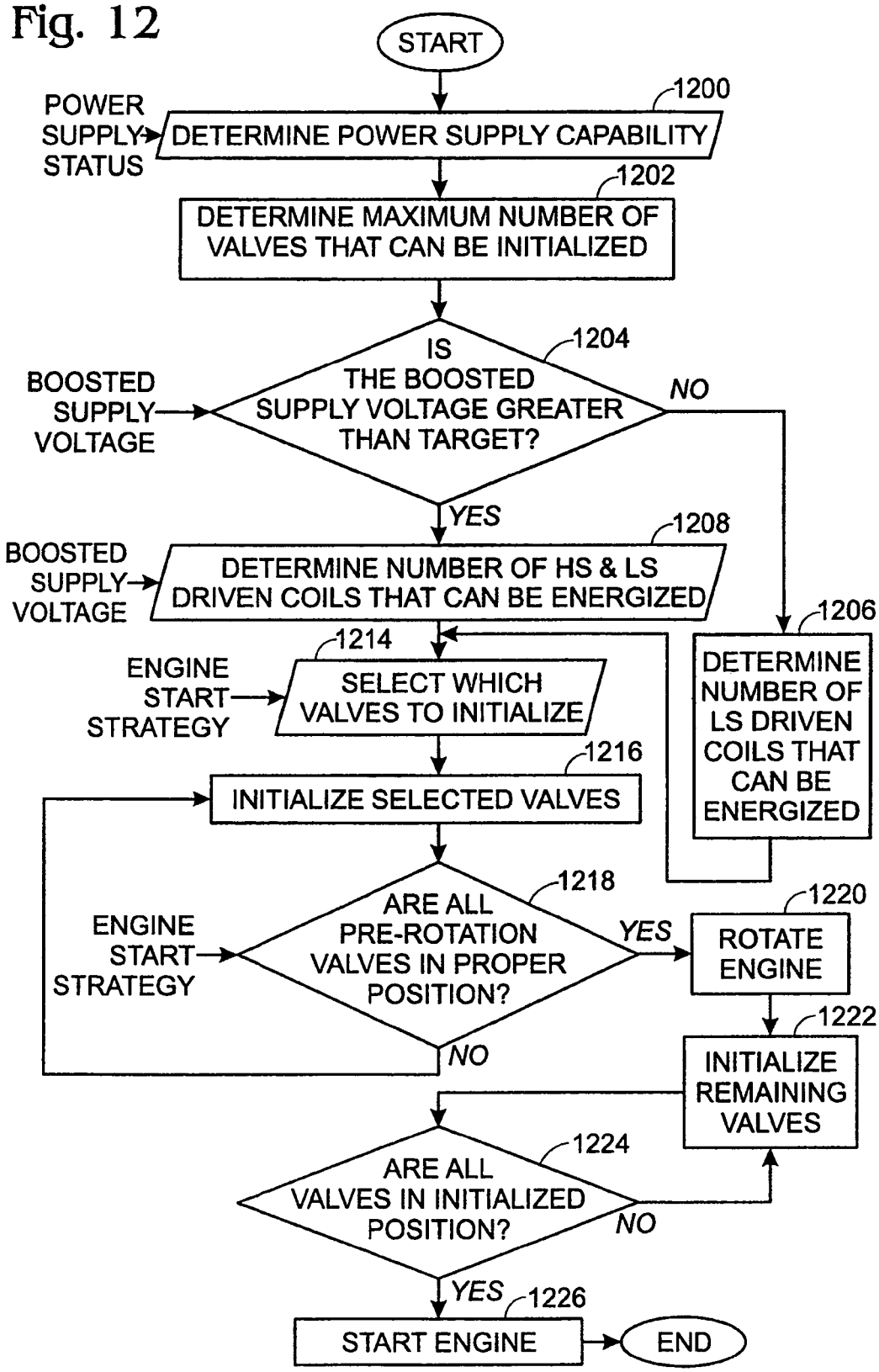

The flowchart in FIG. 12 shows still another alternative embodiment for the initialization of engine valves when a boosted supply dual coil half bridge converter is used, although it can be used with other converter topologies as well. The initialization process for this converter is similar to that for a split supply dual coil half-bridge converter. However, for this converter to energize HS driven coils, a boosted power supply voltage is first generated. This boosted supply voltage may be generated by first energizing LS driven coils, in one example. One example process used to determine whether only LS driven coils or both LS and HS driven coils can be energized is illustrated in the flowchart of FIG. 12 as a branch as 1204, with the path to follow determined by the boosted supply voltage level. The relationship between the boosted supply voltage and the number of LS driven coils that need to be energized may be a calibratable quantity and can be implemented in the algorithm as a look-up table, a fixed mathematical relationship, etc. After the boosted supply voltage is generated to the desired level and the converter has the capability to energize either LS or HS driven coils, the algorithm may operate similar to that for the split supply converter. Similarly to the split supply derivative, an additional boost regulator may be used to maintain the regulation of the boosted power supply voltage whenever the EVA system is active. It may also operate differently during on the startup process, for similar reasons as the midpoint regulator for the split supply converter.

Referring now specifically to FIG. 12, in step 1200 the routine determines example power supply capabilities based on current operating conditions, such as ambient temperature, battery state of charge, engine temperature, battery life, or combinations thereof. Then, in step 1202, the routine determines the number of electromechanically actuated valves that can be simultaneously actuated, due to the status of the vehicle power supply system, and valve actuator operating conditions, before the engine is rotated. This determination may be made based on, but not limited to, voltage, temperature and battery state of charge, valve actuator impedance or combinations thereof. The relationship between the power supply status and the number of valves that can be initialized may be a calibratable quantity and may be implemented in the algorithm as a look-up table, a fixed mathematical relationship, etc.

Once the number of valves is determined in step 1202, the routine determines whether the boosted supply voltage is greater than the target value in step 1204. If not, the routine continues to step 1206 to determine the number of LS coils that can be energized, and then continues to step 1214. Otherwise, if the answer to step 1204 is yes, the routine continues to step 1208 to determine the number of HS and LS driven coils that can be energized.

Then, the routine selects the particular valves to initialize based on the engine strategy, for example, in step 1214, and the information from steps 1200-1208.

Continuing with FIG. 12, the routine then initializes the selected valves in step 1216 before the engine is rotated by an engine starting apparatus, such as a starter motor driven by the vehicle battery. In step 1218 the routine determines whether all of the pre-rotation valves selected in step 1214 have been initialized. If so, the routine continues to step 1220 to rotate the engine under power of the starting apparatus (e.g., starter motor, integrated starter alternator, etc). Otherwise, the routine returns to step 1216.

From step 1220, the routine continues to step 1222 to initialize the remaining valves, and then proceed to step 1224 to determine whether all electromechanical valves are in the desired position. If not, the routine returns to step 1222. If so, the routine continues to step 1226 to start the engine, e.g., start the engine by injecting fuel and igniting it in a combustion stroke of the engine.

It will be appreciated that the configurations and routines disclosed herein are exemplary in nature, and that these specific embodiments are not to be considered in a limiting sense, because numerous variations are possible. For example, the above converter technology can be applied to V-6, I-4, I-6, V-12, opposed 4, and other engine types. Also, the approach described above is not specifically limited to a dual coil valve actuator, or to any of the specific converter configurations described. Rather, it could be applied to other forms of actuators, including ones that have only a single coil per valve actuator, and to actuators powered by different converter topologies.

The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

We claim:

1. A method for initializing electromechanical valves of an engine having a starting apparatus, said initialization includes moving a valve from a neutral initial position, the method comprising:

during an engine start, varying an order of initializing the valves from among a plurality of orders as operating conditions vary, the plurality of orders including at least:

a first order where a first of said valves is initialized before a second of said valves; and a second order where the first of said valves is initialized after the second of said valves, the first and second valves coupled in a common cylinder.

2. The method of claim 1 wherein said operating conditions include power supply capabilities, and where the order is varied among the plurality of orders depending on said power supply capabilities.

3. The method of claim 1 wherein said operating conditions include temperature.

4. The method of claim 1 further comprising varying a number of valves being initialized before engine rotation as operating conditions vary, where during a first condition a first number of valves are initialized, and during a second condition a second, different, number of valves are initialized.

5. The method of claim 1 wherein in one of the first and second orders, the first valve is initialized open and the second valve is initialized closed.

6. The method of claim 1 wherein in the first order, the first valve is initialized open, and the second valve is initialized closed

7. A method for initializing electromechanical valves of an engine having a starting apparatus, the method comprising:

varying a number of valves being initialized before a preselected condition during an engine start;

varying an order of initializing the valves from a plurality of orders during the engine start as operating conditions vary, where said initialization includes moving a valve from an initial neutral position, the plurality of orders including at least:

a first order where a first of said valves is initialized before a second of said valves; and a second order where the first of said valves is initialized after the second of said valves, the first and second valves coupled in a common cylinder.

8. The method of claim 7 further comprising moving at least one mechanically actuated exhaust valve after rotation during the engine start.

9. The method of claim 7 wherein the preselected condition includes engine rotation.

10. A method for initializing electromechanical valves of an engine having a starting apparatus, the method comprising:

varying an order of initializing the valves from a plurality of orders during the engine start as operating conditions vary, where said initialization includes moving a valve from an initial neutral position, the plurality of orders including at least:

a first order where an intake valve of said valves is initialized before an exhaust valve of said valves, the intake valve initialized before cranking rotation of the engine; and a second order where the intake valve of said valves is initialized after the exhaust valve of said valves, the exhaust valve initialized before cranking rotation of the engine, the intake valve initialized after cranking rotation of the engine, the intake and exhaust valves coupled in a common cylinder.

11. The method of claim 10 wherein in one of the first and second orders, the first valve is initialized open and the second valve is initialized closed.

* * * * *